US008749149B2

(12) United States Patent
Naruo et al.

(10) Patent No.: US 8,749,149 B2
(45) Date of Patent: Jun. 10, 2014

(54) LIGHTING DEVICE AND ILLUMINATION APPARATUS USING THE SAME

(75) Inventors: Masahiro Naruo, Osaka (JP); Shigeru Ido, Osaka (JP)

(73) Assignee: Panasonic Corporation, Osaka (JP)

( * ) Notice: Subject to any disclaimer, the term of this patent is extended or adjusted under 35 U.S.C. 154(b) by 209 days.

(21) Appl. No.: 13/416,037

(22) Filed: Mar. 9, 2012

(65) Prior Publication Data

US 2012/0242235 A1 Sep. 27, 2012

(30) Foreign Application Priority Data

Mar. 22, 2011 (JP) ..... 2011-062611

(51) Int. Cl.
*H05B 37/02* (2006.01)

(52) U.S. Cl.
USPC ..... 315/186; 315/209 R; 315/224; 315/247; 315/291; 315/307

(58) Field of Classification Search
USPC ..... 315/186, 209 R, 224, 225, 246, 247, 315/291, 307, 308
See application file for complete search history.

(56) References Cited

U.S. PATENT DOCUMENTS 6,580,309 B2 6/2003 Jacobs et al.
2003/0085749 A1 * 5/2003 Xu et al. ..... 327/423
2006/0170373 A1 * 8/2006 Yang ..... 315/209 R
2010/0127672 A1 5/2010 Chen et al.
2011/0292704 A1 * 12/2011 Makino et al. ..... 363/126

FOREIGN PATENT DOCUMENTS

JP 2006-511078 3/2006
JP 2010-198760 9/2010
WO 2007/049198 5/2007

OTHER PUBLICATIONS

Extended European search report dated Jul. 9, 2012.

* cited by examiner

*Primary Examiner* — Douglas W Owens
*Assistant Examiner* — Thai Pham
(74) *Attorney, Agent, or Firm* — Bacon & Thomas, PLLC

(57) ABSTRACT

A lighting device includes: a lighting unit for supplying a lighting power to a light source unit; and a controller, for controlling the lighting unit. The lighting unit has an inductor and a switching element, and a diode for flowing a flyback current of the inductor to the light source unit during an OFF period of the switching element, and the controller has a unit for intermittently driving an ON/OFF operation of the switching element by a PWM signal and a unit for driving the switching element by a frequency higher than that of the PWM signal during an ON period of the PWM signal, and when the PWM signal falls, the controller reduces a peak value of a load current flowing through the light source unit during a certain period.

13 Claims, 30 Drawing Sheets

LIGHTING DEVICE AND ILLUMINATION APPARATUS USING THE SAME

FIELD OF THE INVENTION

The present invention relates to a lighting device for lighting a solid-state light emitting element such as an LED (Light-Emitting Diode), an OLED (Organic Light-Emitting Diode) or the like, and an illumination apparatus using the same.

BACKGROUND OF THE INVENTION

Conventionally, a power feeding assembly (lighting device) for feeding a power to a light emitting diode (LED) illumination module has been provided, which is disclosed, e.g., in Japanese Patent Application Publication No. 2006-511078 (JP2006-511078A). As shown in FIG. 17, the prior art example described in JP2006-511078A includes a series circuit of a diode D10 and a control switch 101 configured with a MOSFET which are connected to both ends of a DC power supply 100. In addition, an inductor L10 and an LED illumination module 102 are connected to both ends of the diode D10. A controller 103 generates a dual-PWM (Pulse-Width Modulation) switching signal supplied to a control input unit of a control switch 101 through an amplifier 104. The dual-PWM switching signal is a combination of a high-frequency PWM switching signal component and pulse bursts of a low-frequency, i.e., a low-frequency PWM switching signal component.

The controller 103 includes a current mode pulse width modulator 105, which receives an LED current reference signal, a detection current, and a high-frequency sawtooth wave signal from a current supply 106. The current mode pulse width modulator 105 generates a high-frequency PWM switching signal component supplied as one input of an AND gate 107, and the other input of the AND gate 107 is a low-frequency PWM switching signal component. An output from the AND gate 107 is supplied to a gate of the control switch 101 through the amplifier 104.

Thus, in the prior art example, an average current flowing through the LED illumination module 102 can be changed by changing the low-frequency component of the dual-PWM switching signal, and thus, the intensity of light output from the LED illumination module 102 is changed.

However, in the prior art example disclosed in JP2006-511078A, the dual-PWM switching signal supplied to the control input unit of the control switch 101 (switching element) is an AND output of the low-frequency PWM signal and the high-frequency driving signal. For this reason, as shown in FIG. 18A, when the PWM signal falls during an ON period of the control switch 101, the driving signal from the control switch 101 becomes a low level. In this manner, the ON period of the control switch 101 is changed depending on the change in the ON duty ratio of the PWM signal, and accordingly, a load current flowing through the LED illumination module 102 (light source unit), i.e., a light output from the LED illumination module 102, changed. Thus, dimming of the LED illumination module 102 is performed by changing the ON duty ratio of the PWM signal. Also, the waveform shown in FIG. 18A is an example when the control switch 101 is operated in a critical current mode.

Meanwhile, during an OFF period of the control switch 101, since a flyback current of the inductor L10 flows to the LED illumination module 102 through the diode D10, although the PWM signal falls during the corresponding period, a light output from the LED illumination module 102 is not changed. That is, as shown in FIG. 18A, within the range indicated by the dashed single-dotted line in the same drawing, although the ON duty ratio of the PWM signal is swept, a subsequent ON pulse of the driving signal of the control switch 101 is not generated. For this reason, during the interval indicated by the arrow in FIG. 18A, although the ON duty ratio of the PWM signal is swept, the light output from the LED illumination module 102 is not changed. Thus, as shown in FIG. 18B, with respect to the ON duty ratio of the PWM signal, the light output from the LED illumination module 102 is changed stepwise. A light output difference by one step is equivalent to a light output of one cycle of the driving signal of the control switch 101.

Thus, in the prior art example described in JP2006-511078A, when the PWM signal is swept, the light output from the LED illumination module 102 is changed by one step at a time, causing problems in which the light output is not changed smoothly so that a user can see the notable change. In particular, in the prior art, when the LED illumination module 102 is dimmed at a low luminous flux, the change ratio of the light output from the LED illumination module 102 is increased, and thus, the change is seen further notable.

Further, when the LED illumination module 102 is imaged through various imaging devices such as a video camera or the like, the frequency of the PWM signal is required to be increased to have a certain value or higher to prevent blinking due to an interference with a frequency of the imaging device from being observed. In this case, however, when the frequency of the PWM signal is increased, the ratio of one period of the driving signal of control switch 101 to one period of the PWM signal is increased. Then, the light output is increased by one period of the driving signal of the control switch 101 and it is more conspicuously seen such that the light output from the LED illumination module 102 is changed by one step at a time.

In order to avoid this, the frequency of the driving signal of the control switch 101 is required to be increased, but considering an increase in a switching loss or an upper limit of the frequency of the driving signal in case of driving with a low-priced part such as a general IC, and the like, a desirable high-frequency is hardly guaranteed.

SUMMARY OF THE INVENTION

Therefore, the present invention provides a lighting device capable of smoothly changing a light output from a light source unit in sweeping a PWM signal without making a driving signal of a switching element have a high-frequency, and an illumination apparatus using the same.

In accordance with an aspect of the present invention, there is provided a lighting device including: a lighting unit for supplying a lighting power to a light source unit including one or more solid-state light emitting elements by using a DC voltage from a power supply unit as an input; and a controller for controlling the lighting unit.

The lighting unit has a series circuit of an inductor and a switching element, and a diode for recovering stored energy of the inductor for the light source unit during an OFF period of the switching element, and the controller has a unit for, intermittently driving an ON/OFF operation of the switching element by a PWM signal and a unit for driving the switching element by a frequency higher than that of the PWM signal during an ON period of the PWM signal. When the PWM signal falls, the controller reduces a peak value of a load current flowing through the light source unit during a certain period.

The lighting unit may further has a detection circuit for detecting the load current flowing through the light source unit, and the controller may further has: a threshold value adjusting unit for setting and outputting the peak value of the load current; a comparator for comparing an output from the detection circuit with an output from the threshold value adjusting unit: and a driving controller for controlling an ON period of the switching element based on an output from the comparator.

The threshold value adjusting unit may have a capacitor and a charging/discharging circuit for charging or discharging the capacitor based on the PWM signal, and output a charge/discharge voltage of the capacitor as the output.

Preferably, the comparator compares a superimposed voltage obtained by superimposing the output from the detection circuit and that from the threshold value adjusting unit, with a certain reference voltage.

The certain period during which the peak value of the load current is reduced is preferably longer than the OFF period of the switching element during the ON period of the PWM signal.

When the PWM signal rises, the controller preferably controls the ON period the switching element to increase the peak value of the load current during a certain period.

Preferably, the lighting unit is a buck chopper circuit.

The controller may control the switching element in a current critical mode.

The controller may control the switching element in a current discontinuous mode.

The controller may control the switching element in a current continuous mode.

The power supply unit preferably includes an AC/DC converter unit for converting an AC voltage into a desired DC voltage and outputting the converted DC voltage, or a DC/DC converter unit for converting a DC voltage into a desired DC voltage and outputting the converted DC voltage.

The DC voltage from the power supply unit may be obtained from an AC/DC converter and a frequency of the PWM signal is 600 Hz or a multiple of 600 Hz.

In accordance with another aspect of the present invention, there is provide an illumination apparatus including the lighting device described-above and a main body for accommodating at least the light source unit.

BRIEF DESCRIPTION OF THE DRAWINGS

The objects and features of the present invention will become apparent from the following description of embodiments, given in conjunction with the accompanying drawings, in which:

FIGS. 2A and 2B are views describing a dimming operation of the lighting device, in which FIG. 2A shows a case in which a threshold value down period is about 1.5 times an off time in one cycle of a switching element during an ON period of a PWM signal, and FIG. 2B shows a case in which the threshold value down period is about 3 times the off time in one cycle of the switching element during the ON period of the PWM signal;

FIGS. 4A to 4C are views showing different configurations of the lighting device, in which FIG. 4A is a schematic circuit diagram when an AC/DC converter unit is applied to a power supply unit, FIG. 4B is a schematic circuit diagram when a smoothing capacitor is connected in parallel to a light source unit, and FIG. 4C is a schematic circuit diagram when a DC/DC converter unit is applied to the power supply unit;

FIGS. 5A and 5B are views illustrating a second embodiment of a lighting device in accordance with the present invention, in which FIG. 5A is a waveform view in case of dimming, and FIG. 5B is a view showing a correlation between the ON duty ratio of the PWM signal and a light output;

FIGS. 6A and 6B views illustrating a third embodiment of a lighting device in accordance with the present invention, in which FIG. 6A is a schematic circuit diagram, and FIG. 6B is a waveform view in case of dimming;

FIGS. 7A and 7B are views for explaining an operation of the lighting device, in which FIG. 7A is a waveform view when the ON duty ratio of the PWM signal is small, and FIG. 7B is a waveform view when the ON duty ratio of the PWM signal is large;

FIGS. 9A and 9B are views showing a fourth embodiment of a lighting device in accordance with the present invention, in which FIG. 9A is a schematic circuit diagram, and FIG. 9B is a waveform view in case of dimming;

FIGS. 10A and 10B are views showing a fifth embodiment of a lighting device in accordance with the present invention, in which FIG. 10A is a schematic circuit diagram, and FIG. 10B is a waveform view in case of dimming;

FIGS. 11A and 11B are views showing a sixth embodiment of a lighting device in accordance with the present invention, in which FIG. 11A is a schematic circuit diagram, and FIG. 11B is a waveform view in case of dimming;

FIGS. 12A and 12B are views showing a seventh embodiment of a lighting device in accordance with the present invention, in which FIG. 12A is a schematic circuit diagram, and FIG. 12B is a waveform view in case of dimming;

FIGS. 13A and 13B are views showing an eighth embodiment of a lighting device in accordance with the present invention, in which FIG. 13A is a schematic circuit diagram, and FIG. 13B is a waveform view in case of dimming;

FIGS. 14A and 14B are views showing a ninth embodiment of a lighting device in accordance with the present invention, in which FIG. 14A is a schematic circuit diagram, and FIG. 14B is a waveform view in case of dimming;

FIGS. 15A, 15B, and 15C are views showing a tenth embodiment of a lighting device in accordance with the present invention, in which FIG. 15A is a schematic circuit diagram when a lighting unit is configured as a boost chopper circuit, FIG. 15B is a schematic circuit diagram when a lighting unit is configured as a buck-boost chopper circuit, and FIG. 15C is a waveform view in case of dimming;

FIGS. 16A and 16B are views showing an embodiment of an illumination apparatus in accordance with the present invention, in which FIG. 16A is a schematic view of an illumination apparatus of a power source-separation type, and FIG. 16B is an illumination apparatus of a power source-integration type;

FIGS. 18A and 18B are views for explaining the problems of the conventional power feeding assembly for the LED illumination module, in which FIG. 18A is a waveform view in case of dimming, and FIG. 18B is a view showing a correlation between an ON duty ratio of a PWM signal and a light output.

DETAILED DESCRIPTION OF THE EMBODIMENTS (Embodiment 1)

Figure 1:
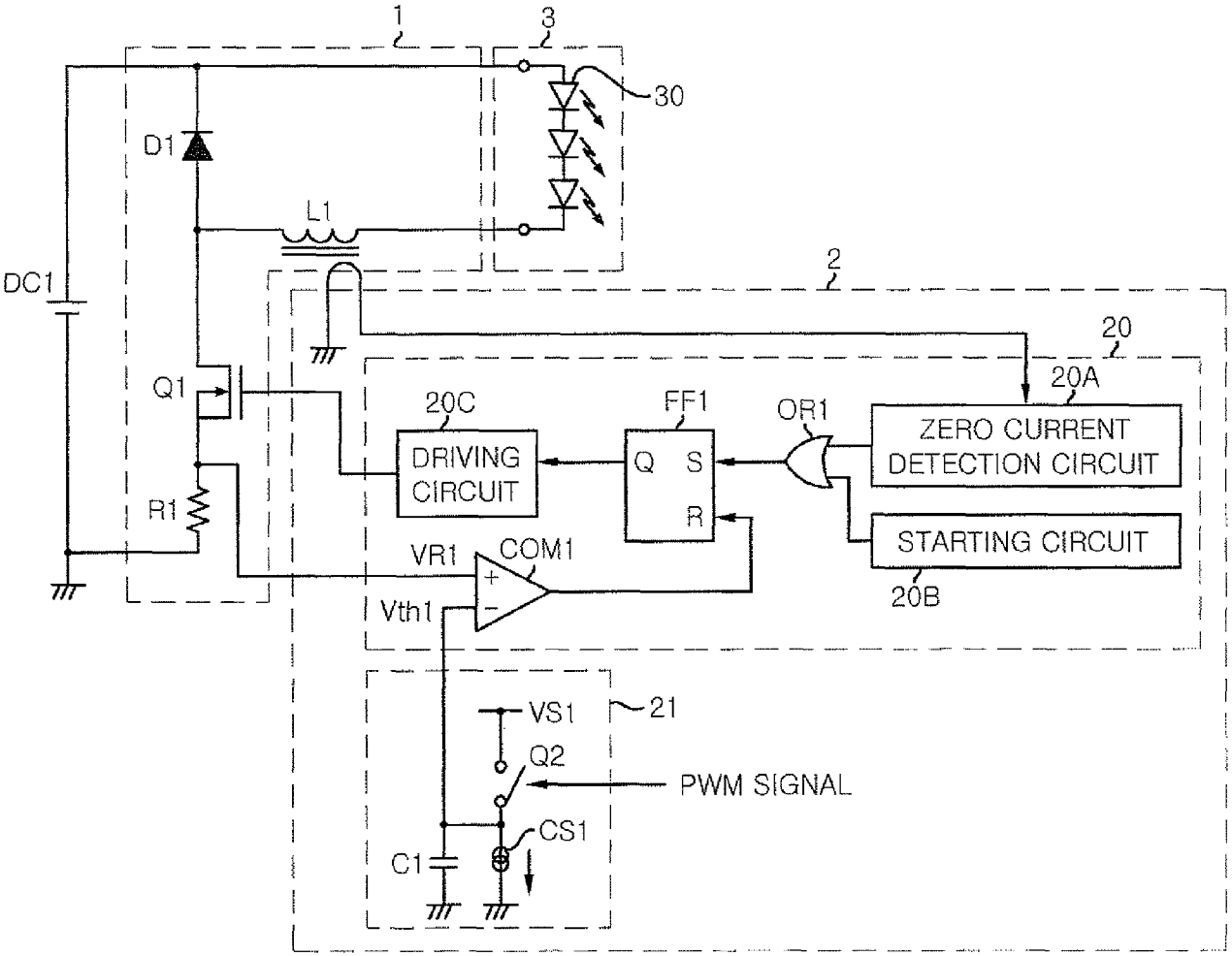
FIG. 1 is a schematic circuit diagram showing a first embodiment of a lighting device in accordance with the present invention.

Hereinafter, a first embodiment of a lighting device in accordance with the present invention will be described with reference to the accompanying drawings. As shown in FIG. 1, the present embodiment includes a lighting unit 1 for supplying a lighting power to a light source unit 3 by stepping down a DC voltage from a DC power supply (power supply unit) DC1, and a controller 2 for controlling an output from the lighting unit 1.

The lighting unit 1 includes a series circuit of a switching element Q1, an inductor L1, and a resistor R1 connected to both ends of the DC power supply DC1. In addition, the lighting unit 1 includes a diode D1 for allowing a flyback current of the inductor L1 to flow during an OFF period of the switching element Q1, and is configured as a buck chopper circuit as a whole. The switching element Q1 is configured with, e.g., an n-channel type MOSFET and performs ON/OFF switching depending on a driving signal applied from a driving circuit 20C (to be described later). The resistor R1 detects a current flowing through the inductor L1 through the switching element Q1, whereby a load current flowing through the light source unit 3 can be detected. One end of a high pressure side of the resistor R1 is connected to a non-inverting input terminal of a comparator COM1 (to be described later). That is, the resistor R1 serves as a detection circuit which detects a voltage between the two ends thereof to thereby detect a load current flowing through the light source unit 3 through the switching element Q1.

The controller 2 includes a driving controller 20 for controlling driving of the switching element Q1 of the lighting unit 1 and a threshold value adjusting unit 21 for adjusting a peak value of the load current. The threshold value adjusting unit 21 also serves as a unit for intermittently driving ON/OFF operation of the switching element Q1 by a PWM signal. The driving controller 20 includes a zero current detection circuit 20A for detecting a zero-cross of the load current with a voltage induced to a secondary coil of the inductor L1, a starting circuit 20B for generating a startup signal, and an OR circuit OR1 to which output signals from the zero-current detection circuit 20A and the starting circuit 20B are inputted.

Additionally, the driving controller 20 includes an RS type flipflop FF1, and an output signal from the OR circuit OR1 is inputted to an S terminal of the flipflop FF1. Also, the driving controller 20 includes a driving circuit 20C for providing a driving signal to the switching element Q1, and an output signal from a Q terminal of the flipflop FF1 is inputted to the driving circuit 20C.

Further, the driving controller 20 includes a comparator COM1 having a non-inverting input terminal to which a detection voltage VR1, which is the voltage between two ends of the resistor R1, is inputted, and an inverting input terminal to which a reference voltage Vth1 (to be described later) is inputted. An output signal from the comparator COM1 is inputted to an R terminal of the flipflop FF1.

The threshold value adjusting unit 21 includes a parallel circuit of a constant current supply CS1 and a capacitor C1, and a constant voltage supply VS1 connected to one end of a high pressure side of the capacitor C1 through a switching element Q2. An ON/OFF operation of the switching element Q2 is switched by a low-frequency PWM signal. Also, the one end of the high pressure side of the capacitor C1 is connected to the inverting input terminal of the comparator COM1.

Accordingly, when the switching element Q2 is turned on, the constant voltage Vref1 of the constant voltage supply VS1 is applied as the reference voltage Vth1 to the inverting input terminal of the comparator COM1 and the capacitor C1 is charged. Further, when the switching element Q2 is turned off, the charge voltage of the capacitor C1 is applied as the reference voltage Vth1 to the inverting input terminal of the comparator COM1 and the capacitor C1 is discharged by the constant current supply CS1. That is, in the threshold value adjusting unit 21, the constant voltage supply VS1, the switching element Q2, and the constant current supply CS1 constitute a charging/discharging circuit of the capacitor C1. Namely, an output voltage from the threshold value adjusting unit 21 is a charge/discharge voltage of the capacitor C1.

The light source unit 3 is configured by connecting multiple (three in the drawing) light emitting diodes (LEDs) 30 in series. Further, in this embodiment, the three LEDs 30 are used, but one or more LEDs 30 may be configured. Further, the respective LEDs 30 may be configured to be connected in parallel, rather than in series. Furthermore, in the present embodiment, the LEDs 30 are used in the light source unit 3, but the light source unit 3 may also be configured with any other solid-state light emitting element (e.g., organic EL device).

Hereinafter, the operation of the present embodiment will be described with reference to the accompanying drawings. First, when a PWM signal becomes a high level for entering an ON period, a startup signal is inputted to the OR circuit OR1 from the starting circuit 20B, and a high level set signal is inputted to the S terminal of the flipflop FF1 from the OR circuit OR1. Accordingly, an output signal from the Q terminal of the flipflop FF1 becomes a high level and a driving signal Is applied to the switching element Q1 from the driving circuit 20C, whereby the switching element Q1 is changed to be turned on. Then, a current flows through the light source unit 3, the inductor L1, the switching element Q1, and the resistor R1, thus increasing the load current (see FIG. 2A). At this time, the PWM signal has the ON period, the switching element Q2 of the threshold value adjusting unit 21 is turned on, and the constant voltage Vref1 of the constant voltage supply VS1 is inputted as the reference voltage Vth1 to the inverting input terminal of the comparator COM1.

Since the load current is increased, the voltage between two ends of the resistor R1, i.e., the detection voltage VR1, is increased. And, when the detection voltage VR1 reaches the reference voltage Vth1, the output signal from the comparator COM1 is inverted and a high level reset signal is inputted to the R terminal of the flipflop FF1. Accordingly, the output signal from the Q terminal of the flipflop FF1 becomes a low level and the supply of driving signal to the switching element Q1 from the driving circuit 20C is stopped, whereby the switching element Q1 is changed to be turned off.

When the switching element Q1 is turned off, a flyback current flows along the closed path of the diode D1, the light source unit 3, and the inductor L1 by stored energy of the inductor L1. The load current, i.e., the current flowing through the inductor L1 is gradually reduced to be finally zero (see FIG. 2A). When the current flowing through the inductor L1 reaches zero and the current is inverted by the action of the inductor L1, charges charged in the switching element Q1 are discharged through parasitic capacitance of an element such as the diode D1 or the like, and a voltage between a drain and a source of the switching element Q1, is lowered. Accordingly, the voltage applied to the inductor L1 is inverted, and thus the corresponding inversion is detected by the zero current detection circuit 20A with a voltage induced to the secondary coil of the inductor L1.

When the zero current detection circuit 20A detects inversion of the voltage applied to the inductor L1, namely, a zero cross of the current flowing through the inductor L1, it inputs a high signal to the OR circuit OR1. Accordingly, a high level set signal is inputted to the S terminal of the flipflop FF1 from the OR circuit OR1. Thus, an output signal from the Q terminal of the flipflop FF1 becomes a high level, and a driving signal is applied to the switching element Q1 from the driving circuit 20C, whereby the switching element Q1 is changed to be turned on. By repeatedly performing these sequential operations, the driving controller 20 of the controller 2 controls the switching element Q1 in a current critical mode. Also, while the load current flows through the light source unit 3, the respective LEDs 30 of the light source unit 3 are turned on.

Next, when the PWM signal has a low level to be shifted to an OFF period, the switching element Q2 is changed to be turned off, and thus, the charge voltage of the capacitor C1 is applied as the reference voltage Vth1 to the inverting input terminal of the comparator COM1. At this time, the capacitor C1 is discharged by the constant current supply CS1, the charge voltage is linearly reduced. Thus, as indicated by the dotted line in FIG. 2A, the reference voltage Vth1 is also linearly reduced. Herein, after, a time period during which the reference voltage Vth1 reaches zero will be referred to as a 'threshold value down period TD1'.

During the threshold value down period TD1, the ON/OFF operation of the switching element Q1 is controlled by using the reference voltage Vth1 which is gradually reduced as a threshold value. Namely, as indicated by the dotted line in FIG. 2A, during the threshold value down period TD1, a peak value Ith1 of the load current is linearly reduced and the ON period of one cycle of the switching element Q1 is also reduced depending on the reduction in the peak value Ith1. In other words, when the PWM signal falls, the controller 2 controls the peak value Ith1 of the load current to be reduced in a certain time period, the load current flowing through the light source unit 3. Accordingly, as shown in FIG. 2A, the cycle of the driving signal is reduced in comparison to the ON period of the PWM signal during the threshold value down period TD1.

Further, when the reference voltage Vth1 reaches zero, since a high level reset signal is consistently inputted to the R terminal of the flipflop FF1, supply of the driving signal to the switching element Q1 from the driving circuit 20C is stopped and the switching element Q1 is maintained in an OFF state. Accordingly, until the PWM signal is shifted to be ON period, the load current does not flow to the light source unit 3, and thus, the respective LEDs 30 of the light source unit 30 are turned off.

In the present embodiment, by repeatedly performing the foregoing sequential operations, the light source unit 3 is dimmed by so-called burst dimming that ON/OFF operation of the switching element Q1 is changed by the low-frequency PWM signal. Namely, the controller 2 intermittently drives ON/OFF operation of the switching element Q1 to control dimming of the light source unit 3 and drives the switching element Q1 by a frequency higher than that of the PWM signal, as shown in FIG. 2A. Accordingly, in the present embodiment, by changing the ON duty ratio of the PWM signal, the ratio between a turn-on time and a turn-off time of the respective LEDs 30 of the light source unit 3 can be changed, and dimming of the light source unit 3 can be executed.

Figure 2A:
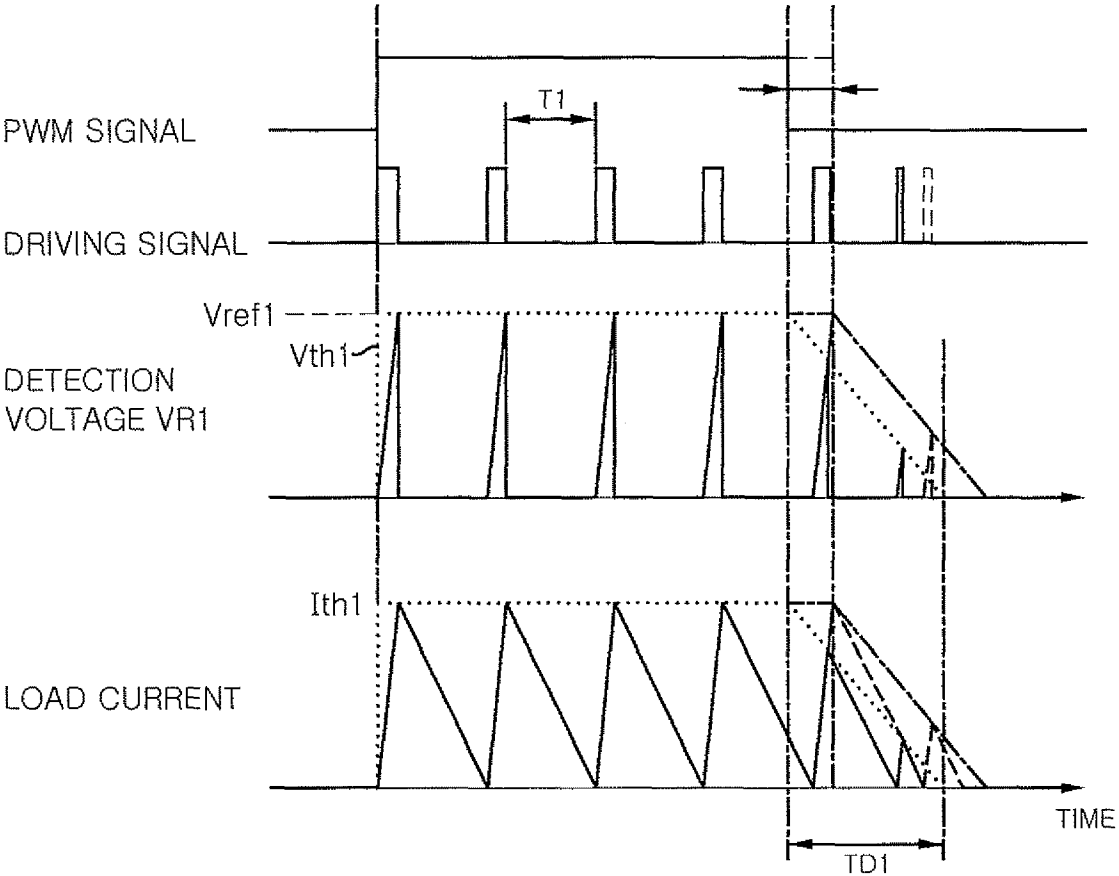

Here, as illustrated by the dashed line in FIG. 2A, when the ON duty ratio of the PWM signal is swept, the reference voltage Vth1 is linearly reduced as indicated by the dashed single-dotted line. Accordingly, the peak value Ith1 of the load current is also linearly reduced as indicated by the dashed single-dotted line in the same drawing. Namely, when the solid line and the dashed single-dotted line in the same drawing are compared, it can be seen that the peak value Ith1 of the load current in the threshold value down period TD1 is continuously changed depending on a continuous change in the ON duty ratio of the PWM signal.

As described above, in the present embodiment, since the load current, i.e., the light output from the light source unit 3, is continuously changed depending on the continuous change in the ON duty ratio of the PWM signal, the change-in the light output from the light source unit 3 when the PWM signal is swept can be smoothly made. In particular, in the prior art, when light source unit 3 is dimmed at a low luminous flux, since the change ratio of the light output from the light source unit 3 is increased, the change is notably seen. However, in the present embodiment, even when the light source unit 3 is dimmed at a low luminous flux, the change in the light output from the light source unit 3 can be smoothly made.

Further, in case where the light source unit 3 is viewed through a different imaging device such as a video camera or the like, even when the frequency of the PWM signal is increased to be a certain value or higher to prevent blinking due to the interference with a frequency of the imaging device from being observed, the change of the light output from the light source unit 3 can be smoothly made. Thus, it is not required to make the driving signal of the switching element Q1 have a high-frequency.

Further, in the dimming shown in FIG. 2A, the threshold value down period TD1 is about 1.5 times the OFF time T1 in one cycle of the switching element Q1 during the ON period of the PWM signal. This is because, if the threshold value down period TD1 is shorter than the OFF time T1, a triangular wave pulse of the load current is not generated during the threshold value down period TD1 and the light output from the light source unit 3 is not changed. Thus, in the present embodiment, the threshold value down period TD1 is set to be longer than the OFF time T1. Also, the threshold value down period TD1 can be changed by changing a capacitance value of the capacitor C1 or changing a current value of the constant current supply CS1 in the threshold value adjusting unit 21.

Figure 2B:
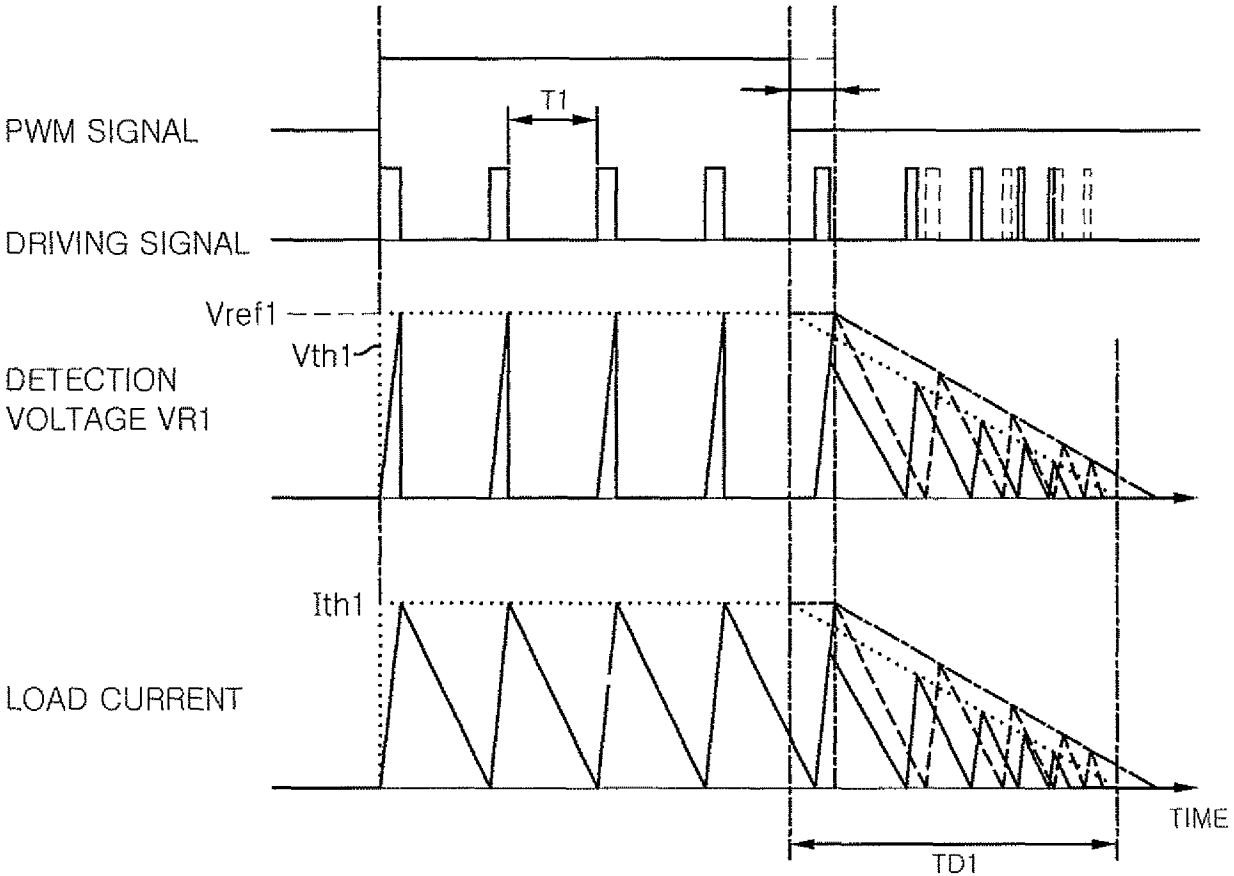
Figure 3:
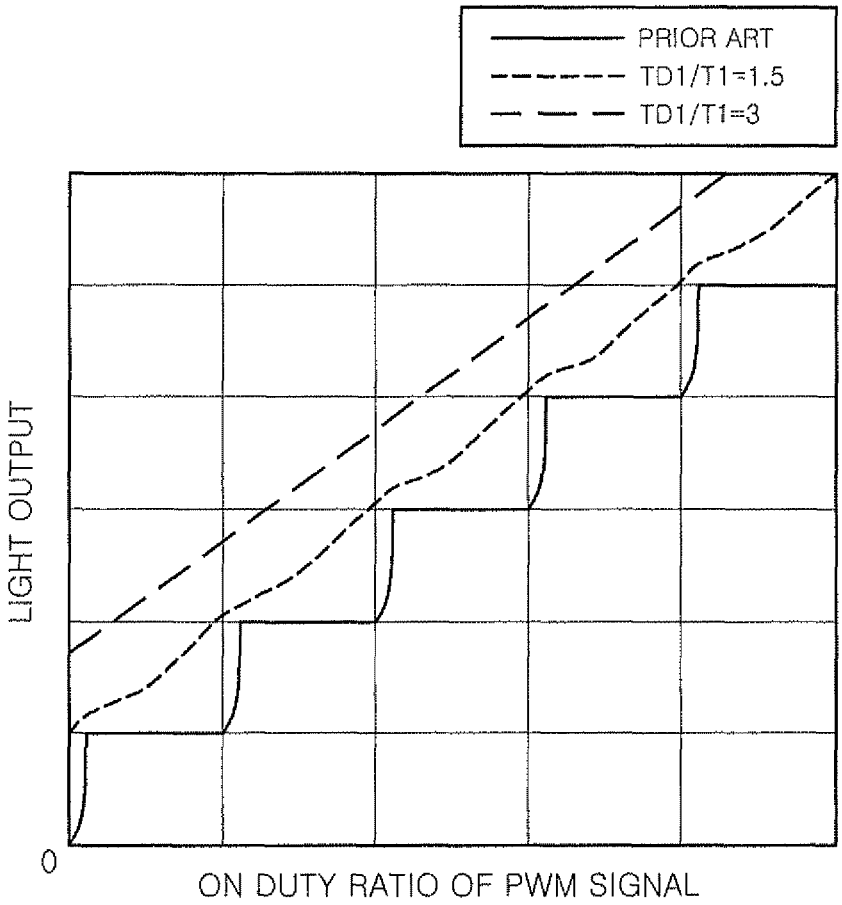
FIG. 3 is a view showing a correlation between an ON duty ratio of the PWM signal and a light output in the lighting device.

Further, as shown in FIG. 25, the threshold value down period TD1 is set to be about 3 times the OFF time T1 to smoothly change the light output from the light source unit 3 in comparison to the case in which the threshold value down period TD1 is about 1.5 times the OFF time T1 (see FIG. 3). This is because, as shown in FIG. 2B, since the number of triangular wave pulses of the load current is increased during the threshold value down period TD1, the change in the load current when the ON duty ratio of the PWM signal is swept is close to be linear.

Figure 4A:
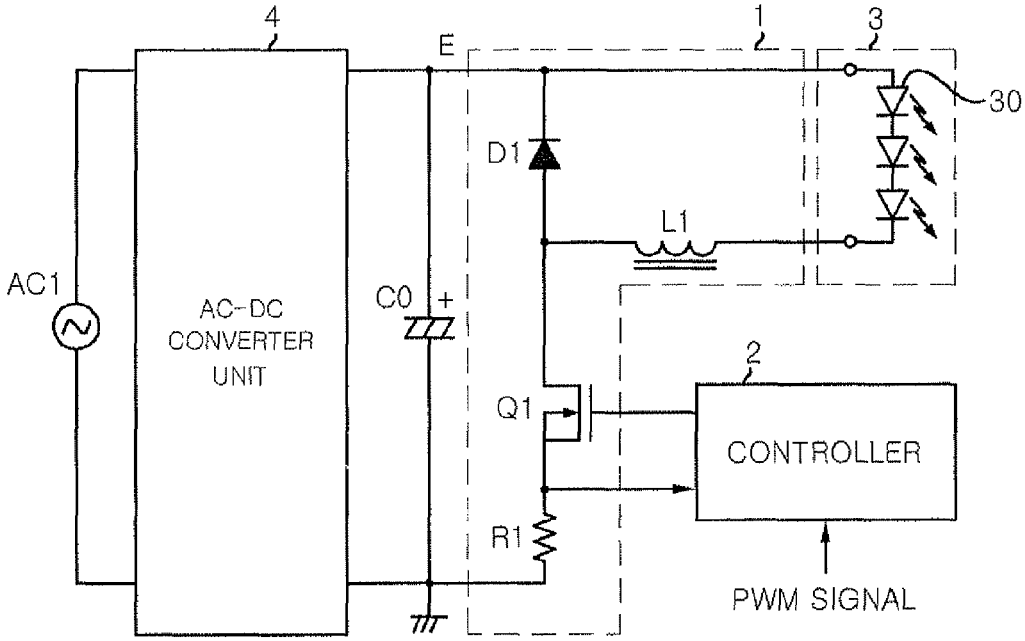

Moreover, in the present embodiment, the DC power supply DC1, is used as a power supply unit, but as shown in FIG. 4A, the power supply unit may be configured with the AC power supply AC1, an AC/DC converter unit 4 for converting an AC voltage from the AC power supply AC1 into a DC voltage and outputting the same, and a smoothing capacitor C0. Meanwhile, the power supply unit may be configured with the DC power supply DC1 and the DC/DC converter unit for converting a DC voltage from the DC power supply DC1 into a desired DC voltage and outputting the same, as shown FIG. 4*c*. In either case, the same effect can be obtained.

Herein, when a commercial power supply having a power frequency of 50 Hz or 60 Hz is used as the AC power supply AC1, ripples of 100 Hz or 120 Hz are generated at the voltage between two ends of the smoothing capacitor C0 due to the design of the AC/DC converter unit 4 or the capacity of the smoothing capacitor C0. Then, there is a possibility in which, depending on the frequency of the PWM signal, the low-frequency of the load current is changed due to an interference of the corresponding ripples and the light output from the light source unit 3 blinks. In order to avoid this, when the power supply unit is configured by using the commercial power supply and the AC/DC converter unit 4, it is preferable to set the frequency of the PWM signal by 600 Hz or a multiple of 600 Hz. Accordingly, the light output from the light source unit 3 is substantially uniform and can be restrained from blinking due to the interference of ripples.

Figure 4B:
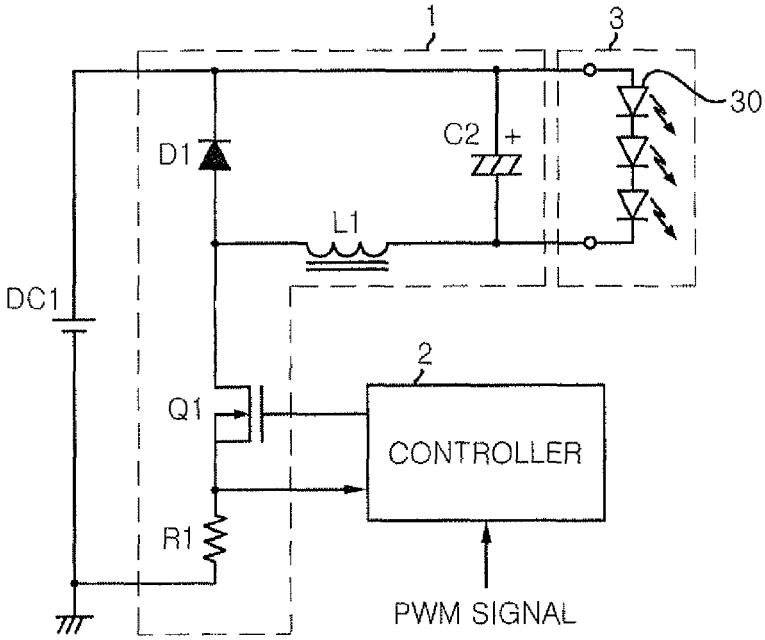
Figure 4C:
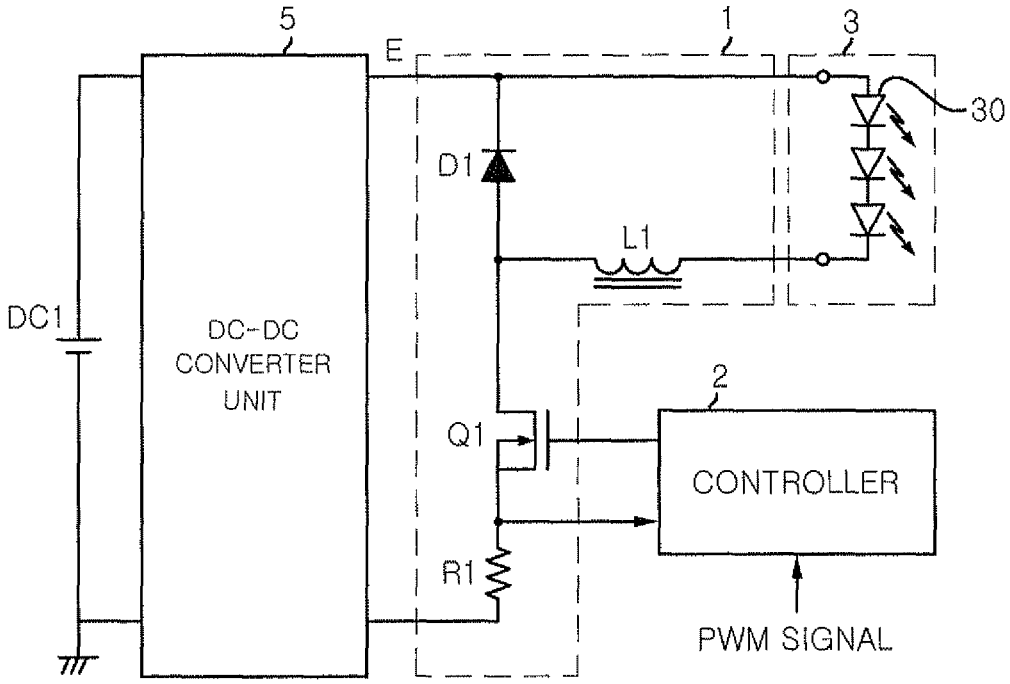

Further, as shown in FIG. 4B, in the lighting unit 1, the smoothing capacitor C2 may be provided to be connected in parallel to the light source unit 3. In this case, since the ripples of the load current flowing through the light source unit 3 can be reduced to be small, the light output from the light source unit 3 can be smoothly changed.

In the lighting unit 1 in accordance with the present embodiment, the switching element Q1 is disposed at a lower pressure side of the DC power supply DC1, but the switching element Q1 may also be disposed at a high pressure side of the DC power supply DC1 to configure the lighting unit 1.

(Embodiment 2)

Figure 5A:
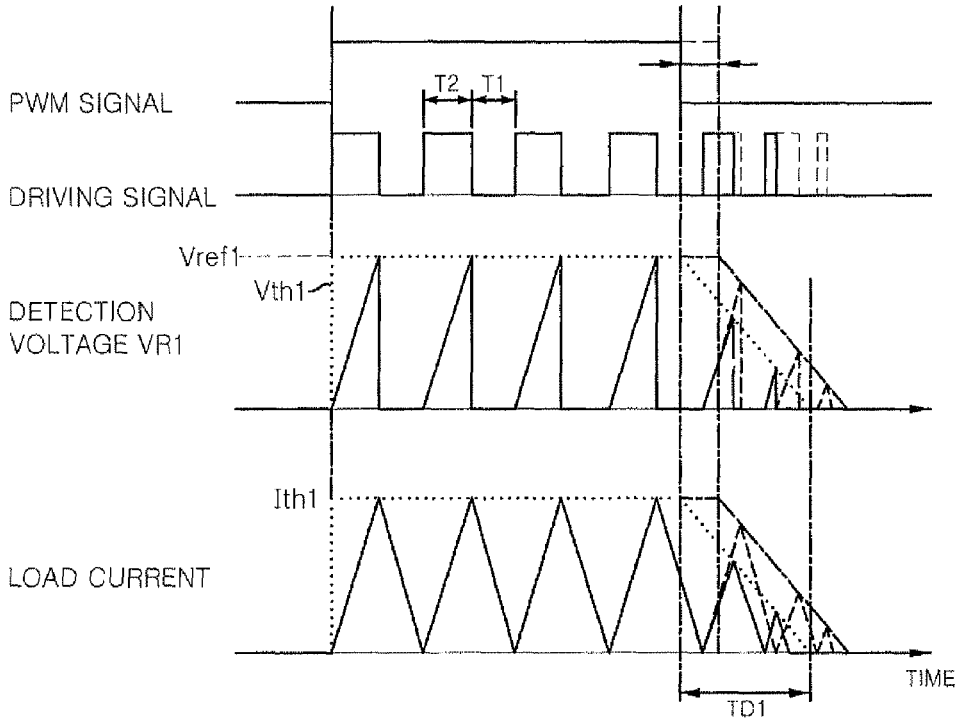

Hereinafter, a second embodiment of the lighting device in accordance with the present invention will be described with reference to the accompanying drawings. Since a basic configuration of the present embodiment is common to that of the first embodiment, the same reference numerals are used for the common parts and a description thereof will be omitted. As shown in FIG. 5A, in comparison to the first embodiment, the present embodiment features that the ON duty ratio of the switching element Q1 is large. The reason will be described hereinafter.

In first embodiment, a change in time of the current flowing through the switching element Q1 is expressed by the following equation:

$$Id = \frac{E - V}{L} t \qquad \text{Eq. 1}$$

In the above Eq. 1, 'Id' is a current flowing through the switching element Q1, 'E' is a DC voltage from the DC power supply DC1, 'V' is a load voltage of the light source unit 3, 'L' is inductance of the inductor L1, and 't' is a lapse time. Also, a turn-on start time of the switching element Q1 is set to be 't=0'.

Herein, the current, i.e., the load current, flowing through the inductor L1 when the switching element Q1 is turned on is the same as the current flowing through the switching element Q1 expressed by Eq. 1. Meanwhile, change in time of the current, i.e., the load current, flowing through the inductor L1 when the switching element Q1 is turned off is expressed by Eq. 2 shown below:

$$IL = -\frac{V}{L}(t - T2) + Ith1 \qquad \text{Eq. 2}$$

In the above Eq. 2, 'IL' is a current flowing through the inductor L1 when the switching element Q1 is turned off, and 'T2' is an ON time in one cycle of the switching element Q1 during the ON period of the PWM signal.

Thus, based on Eqs. 1 and 2, the OFF time T1 and the ON time T2 of the switching element Q1 are expressed by Eqs. 3 and 4, as shown below:

$$T1 = \frac{L}{V} Ith1 \qquad \text{Eq. 3}$$

$$T2 = \frac{L}{E - V} Ith1 \qquad \text{Eq. 4}$$

With Eqs. 3 and 4, the ON duty ratio of the switching element Q1 is expressed by Eq. 5 shown below:

$$Don = \frac{T2}{T1 + T2} = \frac{V}{E} \qquad \text{Eq. 5}$$

In the above Eq. 5, 'Don' denotes the ON duty ratio of the switching element Q1. Thus, it can be seen that the ON duty ratio of the switching element Q1 is determined by the DC voltage from the DC power supply DC1 and the load voltage of the light source unit 3.

Herein, in consideration of stability of the dimming operation or the accuracy of dimming of the light output from the light source unit 3, it is preferable that the amount of change of the ON time T2 of the switching element Q2 is larger than that of the ON time of the PWM signal. Further, since the last triangular wave pulse of the load current generated during the threshold value down period TD1 is equivalent to minimum resolution of the load current, i.e., the light output from the light source unit 3, the light output from the light source unit 3 can be smoothly changed as the corresponding triangular wave pulse is smaller. When the peak value Ith1 of the load current and the driving frequency of the switching element Q1 during the ON period of the PWM signal are uniform, the corresponding triangular wave pulse is smaller as the ON duty ratio of the switching element Q1 is larger. Thus, the light output from the light source unit 3 can be more smoothly changed by increasing the ON duty ratio of the switching element Q1.

Hereinafter, a change in the light output from the light source unit 3 when the ON duty ratio of the switching element Q1 is changed will be described with reference to FIG. 5B.

Figure 5B:
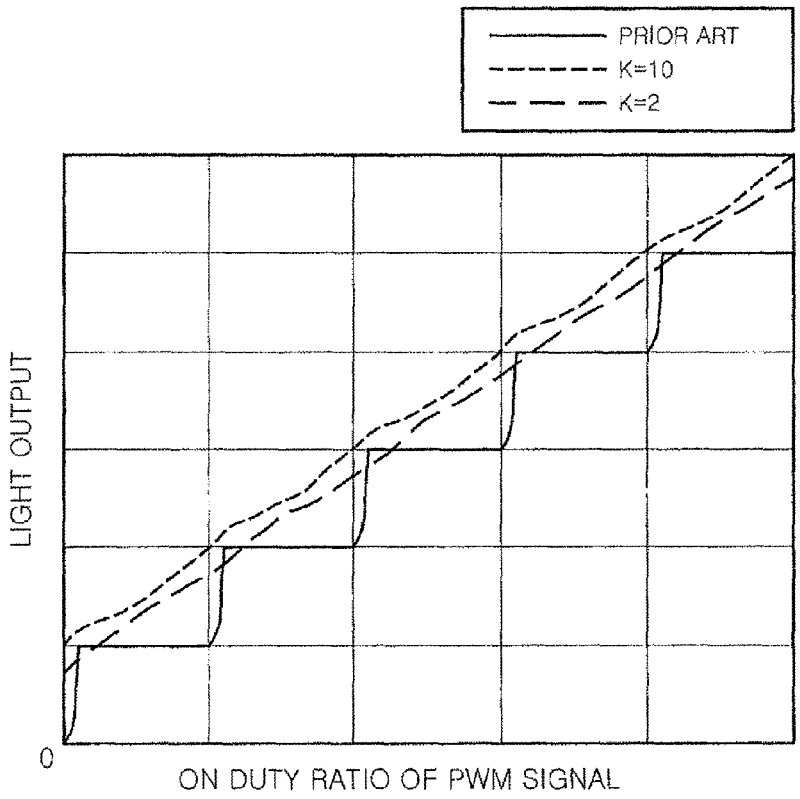

In FIG. 5B, 'K' is an integer represented as 'K=1/Don'. In FIG. 5B, a correlation between the ON duty ratio of the PWM signal and the light output in the prior art example is indicated by the solid line, and in this case, K is assumed to be 10 (K=10). Further, a correlation between the ON duty ratio of the PWM signal and the light output in the case of 'TD1/T1=1.5' in the first embodiment is indicated by the dotted line, and in the corresponding case, K=10 as in the prior art example.

Furthermore, the correlation between the ON duty ratio of the PWM signal and the light output in the case of 'TD1/T1=1.5' in the present embodiment is indicated by the dashed line, and in the corresponding case, K is assumed to be two (K=2). Thus, as noted in FIG. 5B, as 'K' is smaller, namely, as the ON duty ratio of the switching element Q1 is larger, the light output from the light source unit 3 can be more smoothly (linearly) changed.

With this regard, in an actual operation, considering the stability of dimming operation and accuracy of dimming of the light output from the light source unit 3, the DC voltage of the DC power supply DC1 is preferably equal to or less than five times the load voltage of the light source unit 3. Further, a lower limit of the DC voltage of the DC power supply DC1 is required to be at least larger than the load voltage of the light source unit 3, i.e., K is greater than one (K>1), to ensure the chopper operation by the lighting unit 1. More preferably, considering the change in the load voltage depending on temperature characteristics of the respective LEDs 30 of the light source unit 3, K needs to be equal to or greater than 1.2 (K≥1.2).

(Embodiment 3)

Figure 6A:
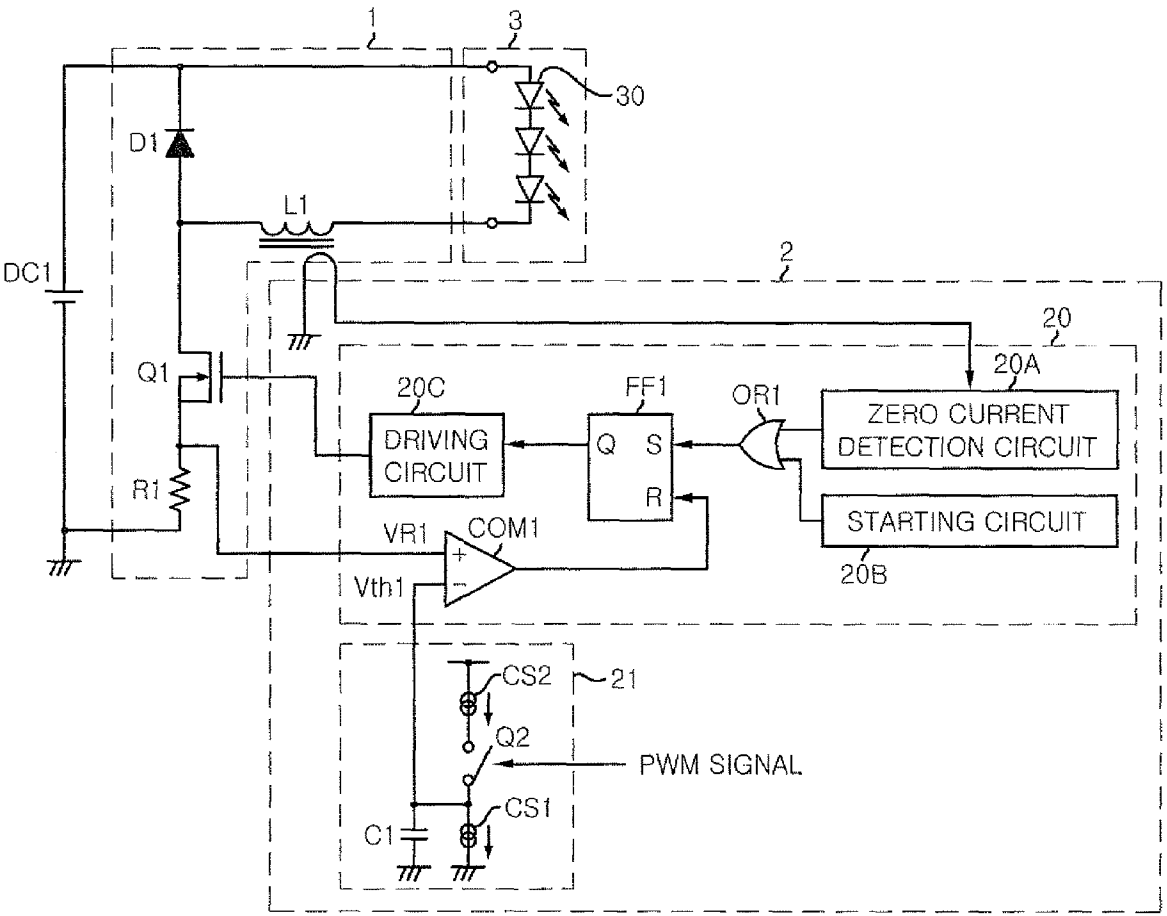
Figure 6B:
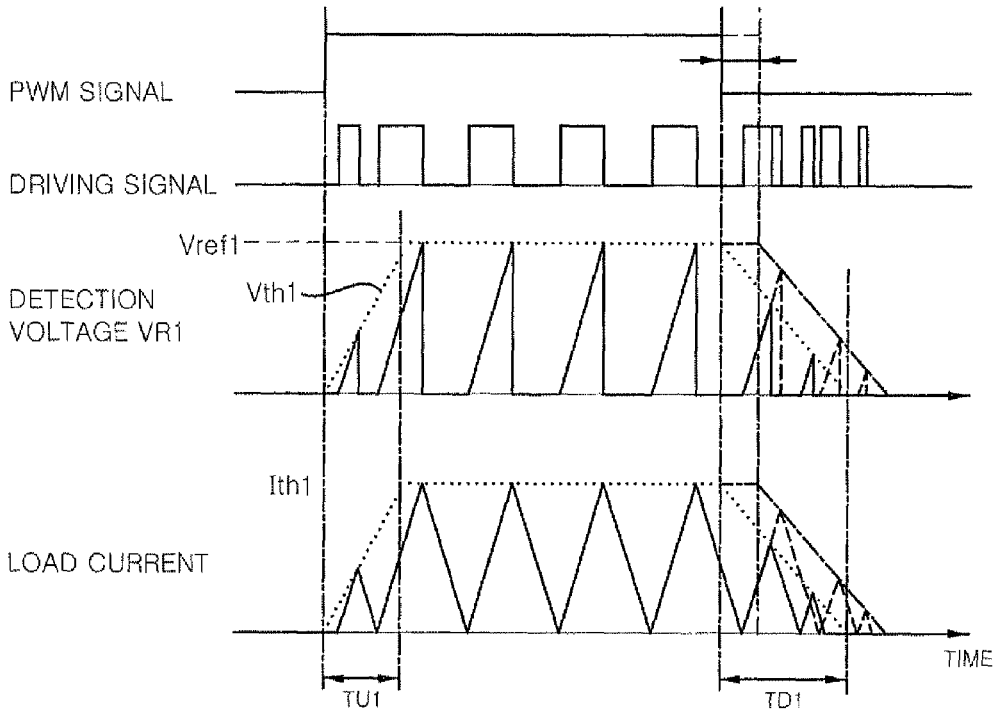

Hereinafter, a third embodiment of the lighting device in accordance with the present invention will be described with reference to the accompanying drawings. Since a basic configuration of the present embodiment is common to that of the first embodiment, the same reference numerals are used for the common parts and a description thereof will be omitted. As illustrated in FIGS. 6A and 6B, the present embodiment features that a constant current supply CS2 is provided instead of the constant voltage supply VS1 in the threshold value adjusting unit 21, thus linearly increasing the peak value Ith1 of the load current when the PWM signal rises.

Hereinafter, the operation when the PWM signal rises will be described with reference to the accompanying drawings. In the first embodiment, during the ON period of the PWM signal, the constant voltage VRef1 of the constant voltage supply VS1 is inputted as the reference voltage Vth1 to the inverting input terminal of the comparator COM1, but in the present embodiment, a charge voltage of the capacitor C1 is inputted instead.

First, when the PWM signal rises, the switching element Q2 is changed to be turned on, and the capacitor C1 is charged by the difference between a constant current flowing from the constant current supply CS2 and a constant current flowing from the constant current supply CS1. Accordingly, since the charge voltage of the capacitor C1 is linearly increased, the reference voltage Vth1 is also linearly increased as indicated by the dotted line in FIG. 6B. A time duration until the reference voltage Vth1 reaches the constant voltage Vref1 is called a 'threshold value up period TU1'. During the threshold value up period TU1, the ON/OFF operation of the switching element Q1 is controlled by using the gradually increased reference voltage Vth1 as a threshold value.

An operation after the reference voltage Vth1 reaches the constant voltage VRef1 is the same as that of the first embodiment. Also, a tilt of the reference voltage Vth1 during the threshold value up period TU1 is determined by the charge current of the capacitor C1, namely, by the difference between the constant current flowing from the constant current supply CS2 and the constant current flowing from the constant current supply CS1.

Figure 7A:
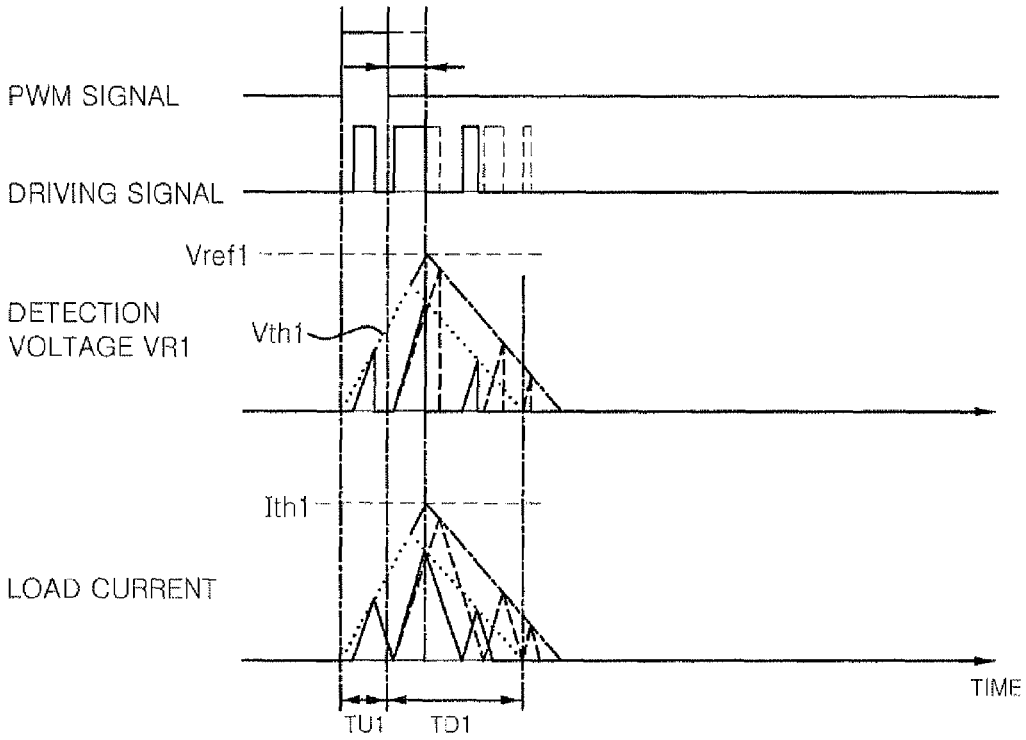

Herein, when the ON duty ratio of the PWM signal is small (close to 0%), the reference voltage Vth1 does not reach the constant voltage Vref1 during the threshold value up period TU1 as indicated by the dotted line in FIG. 7A. Thus, the peak value Ith1 of the load current during the threshold value up period TU1 is continuously changed depending on a continuous change in the ON duty ratio of the PWM signal. For this reason, as the ON duty ratio of the PWM signal is close to 0%, the peak value Ith1 of the load current is continuously reduced to zero.

Figure 7B:
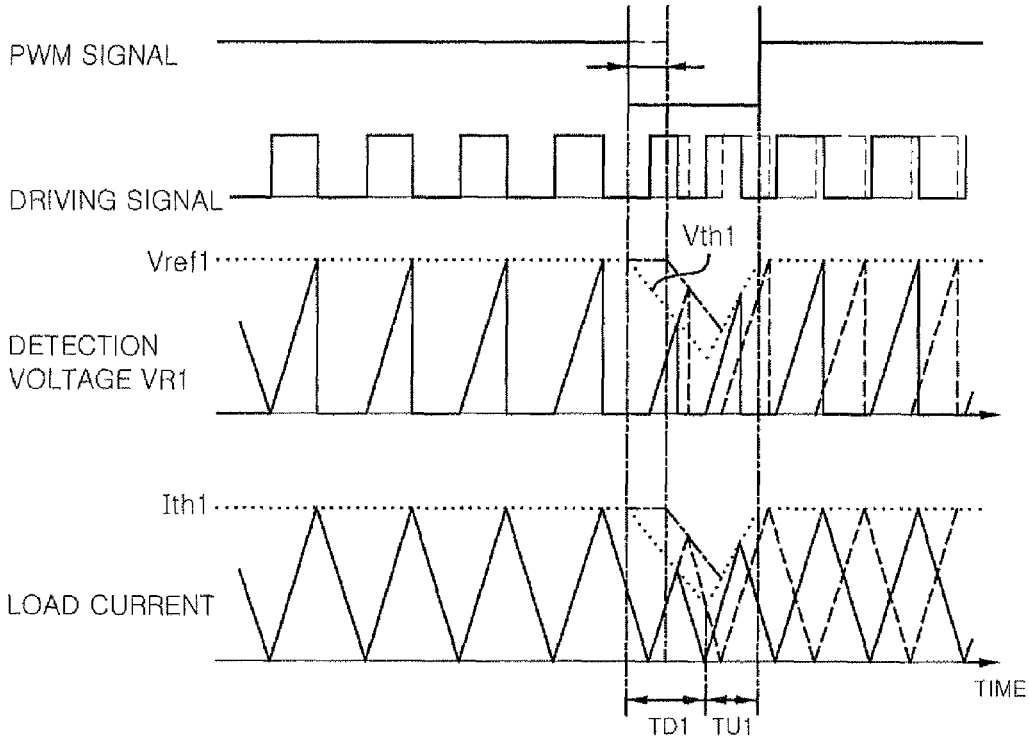

Further, when the ON duty ratio of the PWM signal is large (close to 100%), the reference voltage Vth1 does not reach zero during the threshold value down period TD1 and the threshold value up period TU1 as indicated by the dotted line in FIG. 7B. Thus, as the ON duty ratio of the PWM signal is close to 100%, the peak value Ith1 of the load current is continuously increased until the light output from the light source 3 is maximized.

Figure 8:
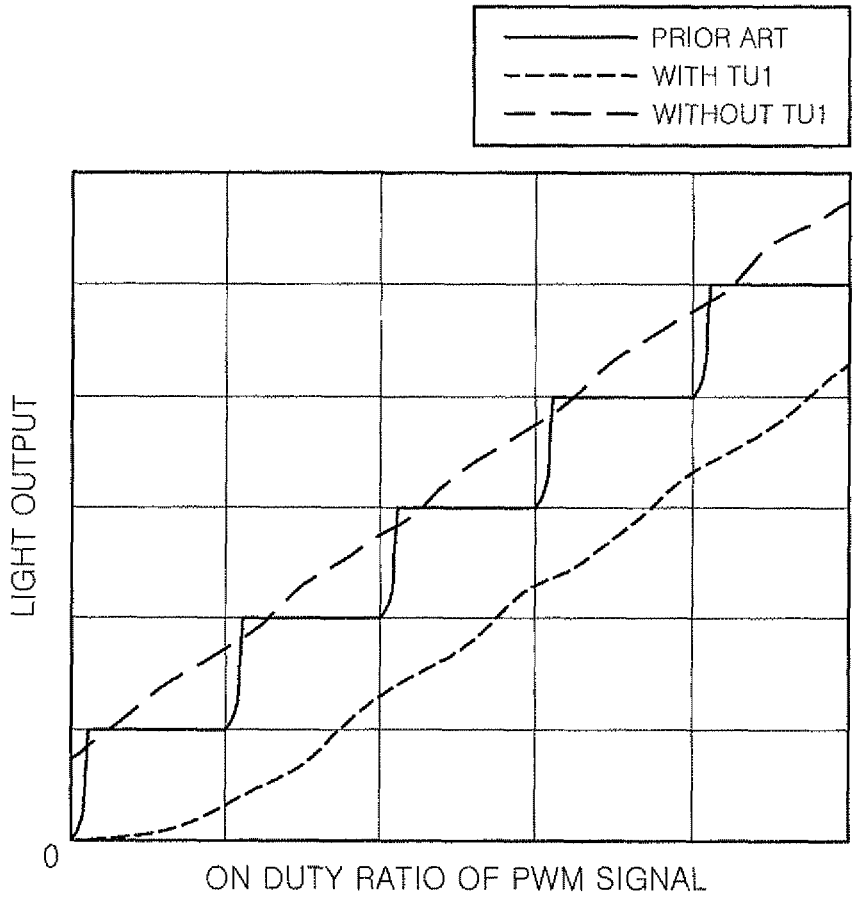
FIG. 8 is a view showing a correlation between the ON duty ratio of the PWM signal and a light output in the lighting device.

Hereinafter, a change in the light output from the light source unit 3 when the ON duty ratio of the switching element Q1 is changed will be described with reference to FIG. 8. In FIG. 8, a correlation between the ON duty ratio of the PWM signal and the light output in case of 'K=2' in the second embodiment is indicated by a dashed line. Also, in FIG. 8, a correlation between the ON duty ratio of the PWM signal and the light output in the case where the threshold value up period TU1 is considered (i.e., in case of employing the present embodiment) under the foregoing condition is indicated by a dotted line.

As can be seen from FIG. 8, since the threshold value up period TU1 is provided, the light output from the light source unit 3 can be smoothly changed from an almost zero to a maximum output. In particular, by setting the threshold value up period TU1 and the threshold value down period TD1 such that they are almost equal, the ON duty ratio of the PWM signal-and the light output from the light source unit 3 have an almost proportional relationship, which is preferable.

(Embodiment 4)

Figure 9A:
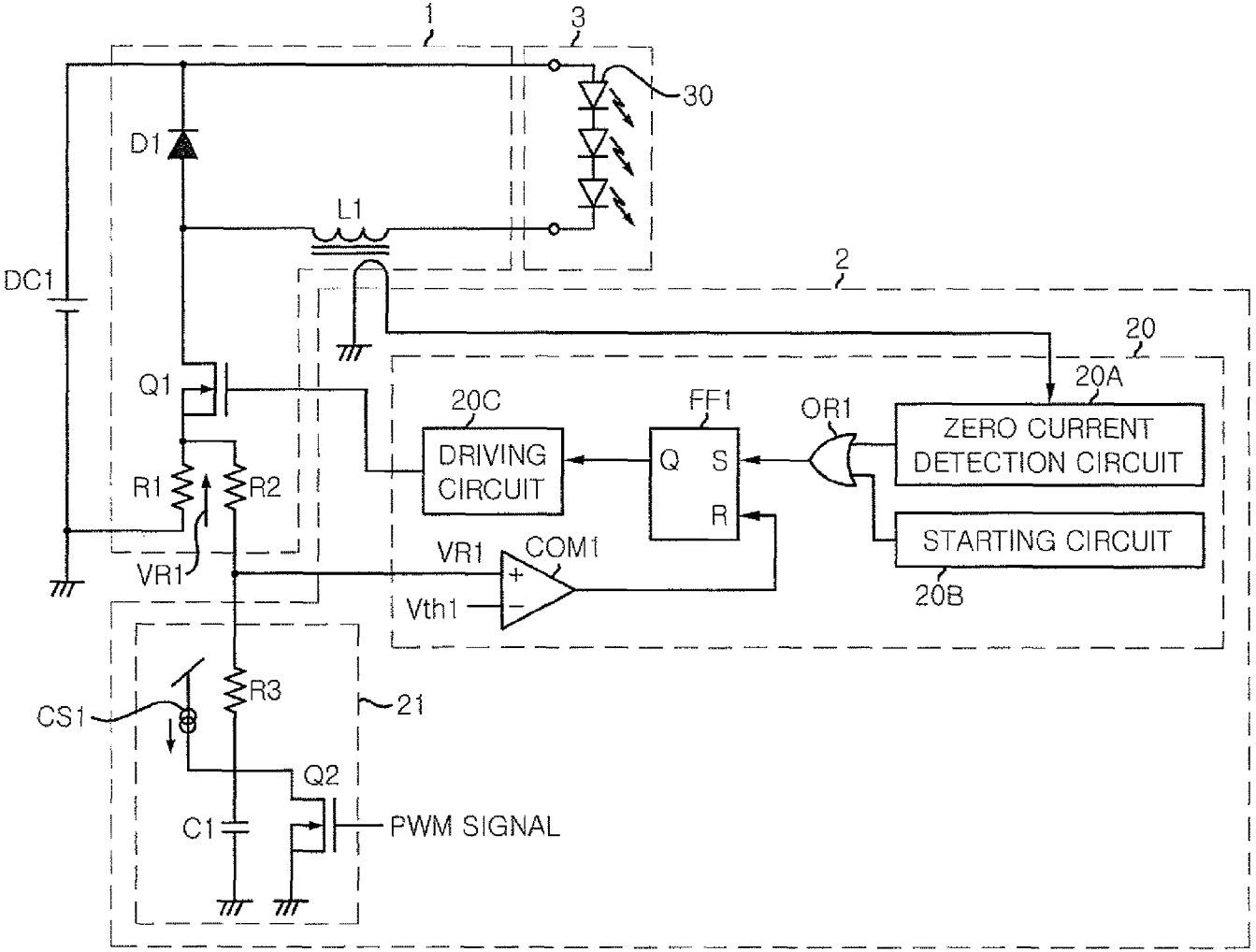
Figure 9B:
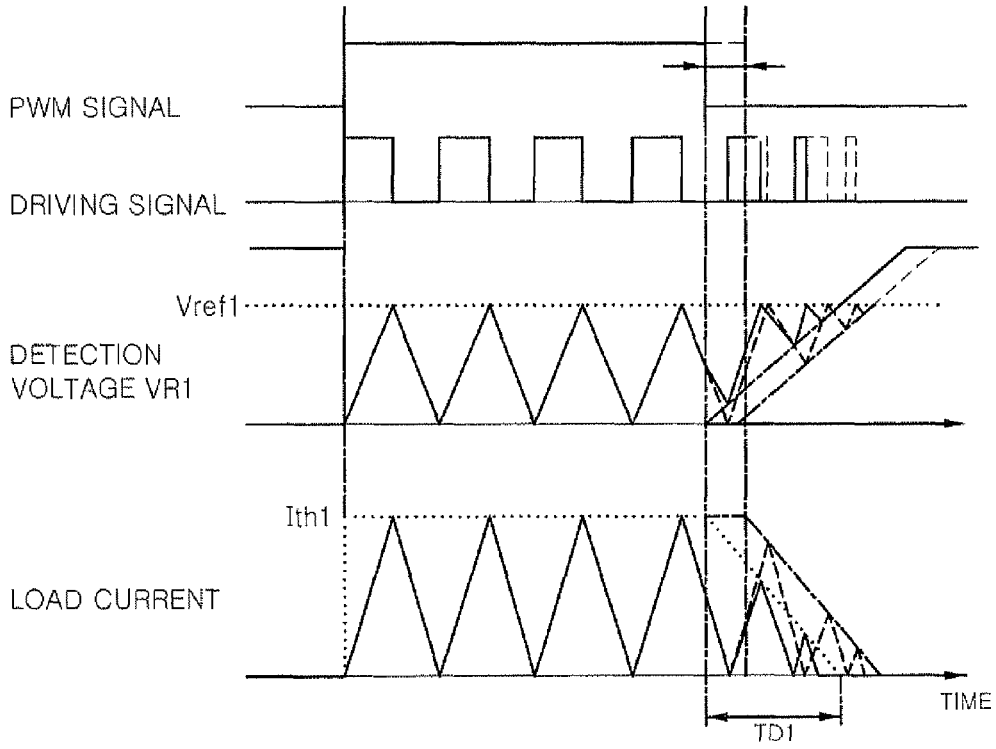

Hereinafter, a fourth embodiment of the lighting device in accordance with the present invention will be described with reference to the accompanying drawings. Since, a basic configuration of the present embodiment is common to that of the first embodiment, the same reference numerals are used for the common parts and a description thereof will be omitted. As shown in FIGS. 9A and 9B, the present embodiment features that the constant voltage VRef1 is inputted to the inverting input terminal of the comparator COM1 of the driving controller 20 and an superimposed voltage V1 (to be described later) is increased during the OFF period of the PWM signal, thereby reducing the peak value Ith1 of the load current.

In the threshold value adjusting unit 21, the constant current supply CS1 and the capacitor C1 are connected in series and the capacitor C1 and the switching element Q2 are connected in parallel. Thus, the capacitor C1 is discharged during the ON period of the PWM signal and it is charged by the constant current from the constant current supply CS1 during the OFF period of the PWM signal. In addition, the resistor R3 is connected in series to the capacitor C1 and the resistor R2 is connected in series to the resistor R1 of the lighting unit 1. Further, a connection point of the resistors R2 and R3 is connected to the non-inverting input terminal of the comparator COM1.

Thus, the charge voltage V1, which is the sum of the voltages obtained by respectively multiplying coefficients determined in the resistors R2 and R3 to the detection voltage VR1, as the voltage between two ends of the resistor R1, and the charge voltage of the capacitor C1, is inputted to the non-inverting input terminal of the comparator COM1.

Hereinafter, the operation of the present embodiment will be described with reference to FIG. 9B. During the ON period of the PWM signal, the switching element Q2 is in an ON state, and thus, the capacitor C1 is not charged. Therefore, since the superimposed voltage V1 based only on the detection voltage VR1 is inputted to the non-inverting input terminal of the comparator COM1, the switching element Q1 is repeatedly turned on and off periodically, and the peak value Ith1 of the load current becomes uniform.

Further, when the PWM signal is shifted into the OFF period, the switching element Q2 is changed to be turned off, and thus, the capacitor C12 starts to be charged. Thus, the superimposed voltage V1 based on the detection voltage VR1 and the charge voltage of the capacitor C1 is inputted to the non-inverting input terminal of the comparator COM1. Herein, as indicated by the dashed single-dotted line in FIG. 9B, the charge voltage of the capacitor C1 is linearly increased with the lapse of time, and finally, is higher than the reference voltage Vref1. For this reason, during the OFF period of the PWM signal, since the superimposed voltage V1 is gradually increased, the cycle of the switching element Q1 is gradually reduced and the peak value Ith1 of the load current is linearly reduced. Namely, during the OFF period of the PWM signal, as in the first embodiment, the threshold value down period TD1 can be provided.

As described above, in the present embodiment, as in the first embodiment, the threshold value down period TD1 can be provided, and therefore, the same effect as that of the first embodiment can be obtained.

Here, it may be considered that the controller 2 is configured by using a general PFC (Power Factor Correction) control IC such as MC33262 of ON Semiconductor or L6562 of ST Micro Electronics in order to eliminate harmonics. Since the general PFC control IC has a reference voltage supply therein, in the configuration of the first embodiment, the reference voltage Vth1 cannot be variably controlled, and thus, the peak value Ith1 of the load current cannot be variably controlled. Meanwhile, in the configuration of this embodiment, the peak value Ith1 of the load current can be variably controlled even when the global PFC control IC is utilized, whereby the number of components constituting the controller 2 can be reduced.

(Embodiment 5)

Figure 10A:
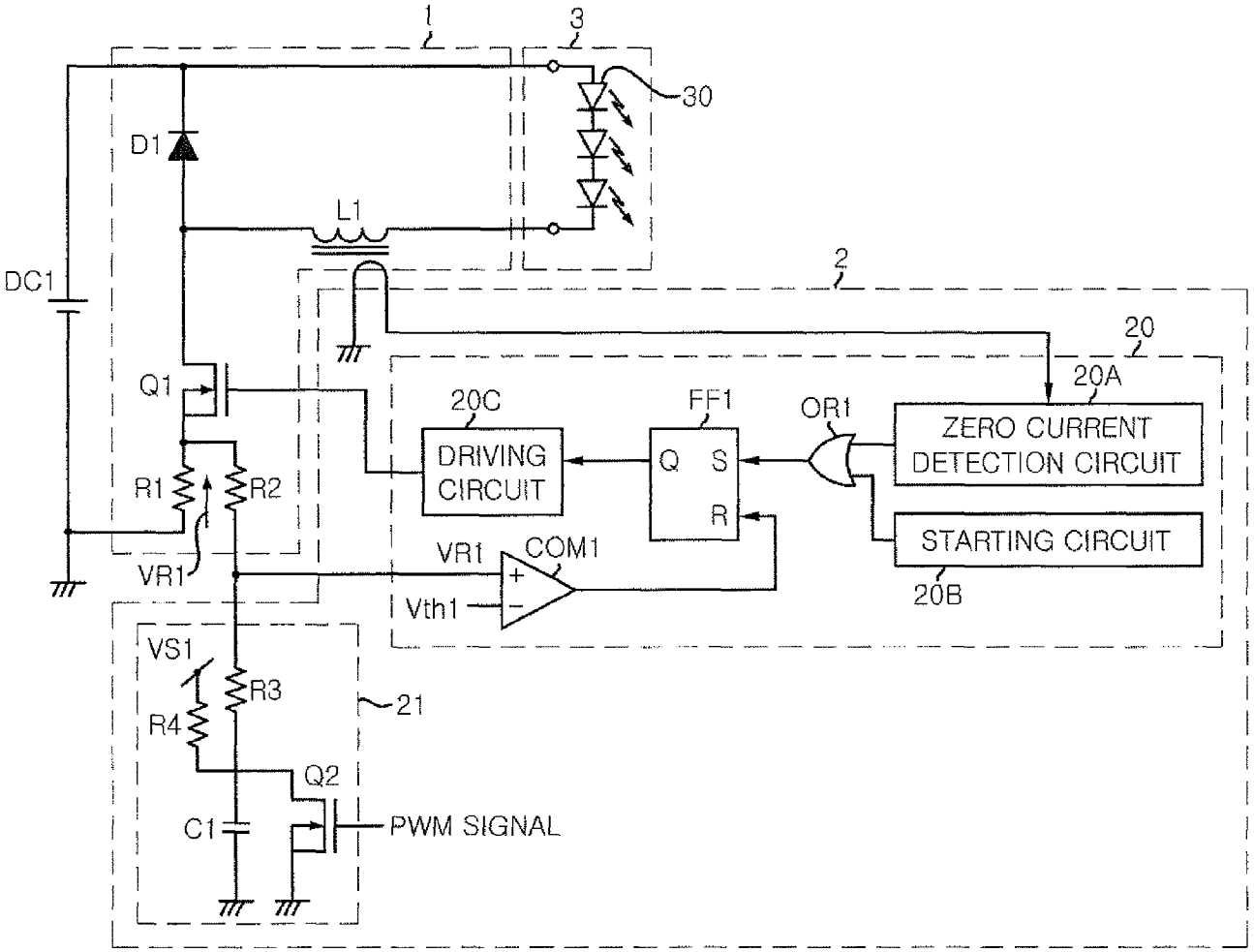

Hereinafter, a fifth embodiment of the lighting device in accordance with the present invention will be described with reference to the accompanying drawings. Since a basic configuration of the present embodiment is common to that of the fourth embodiment, the same reference numerals are used for the common parts and a description thereof will be omitted. As shown in FIG. 10A, the present embodiment features that a series circuit of the constant voltage supply VS1 and a resistor R4 instead of the constant current supply CS1 is provided in the threshold value adjusting unit 21.

Figure 10B:
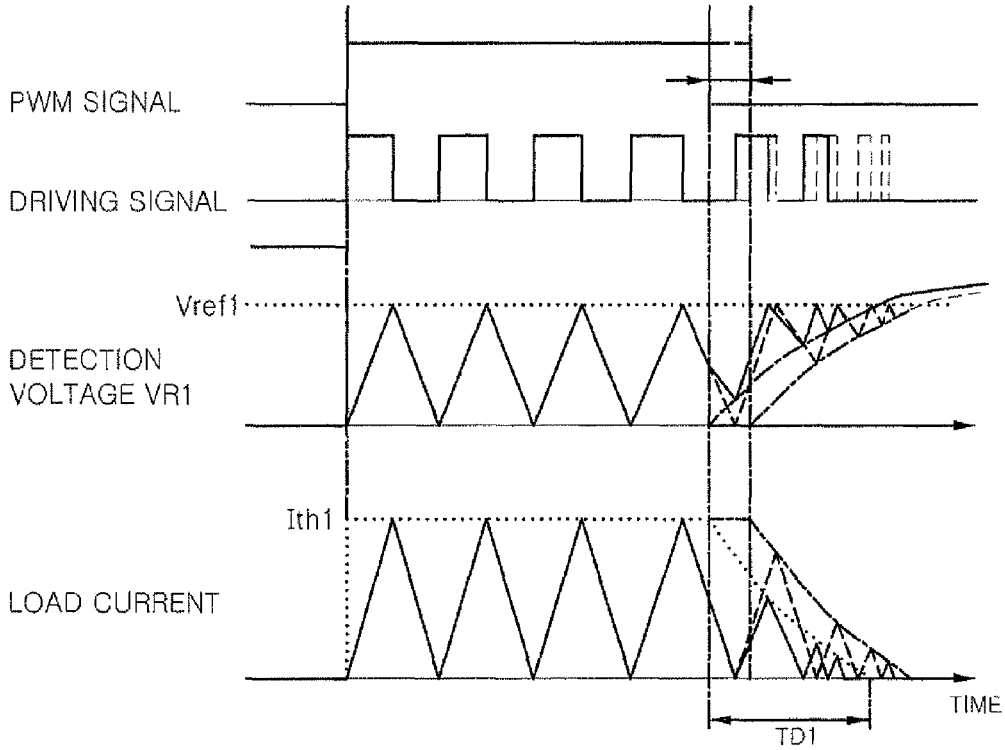

In the fourth embodiment, during the OFF period of the PWM signal, the charge voltage of the capacitor C1 is linearly increased by the constant current of the constant current supply CS1. Meanwhile, in the present embodiment, since the resistor R4 and the capacitor C1 constitute an integrator circuit, the charge voltage of the capacitor C1 is exponentially increased as shown in FIG. 10B. Thus, during the threshold value down period TD1, the peak value Ith1 of the load current is also exponentially reduced.

As described above, in the present embodiment, since the constant voltage supply VS1 and the resistor R4 are used without the constant current CS1, the same effect as that of the fourth embodiment can be obtained.

(Embodiment 6)

Figure 11A:
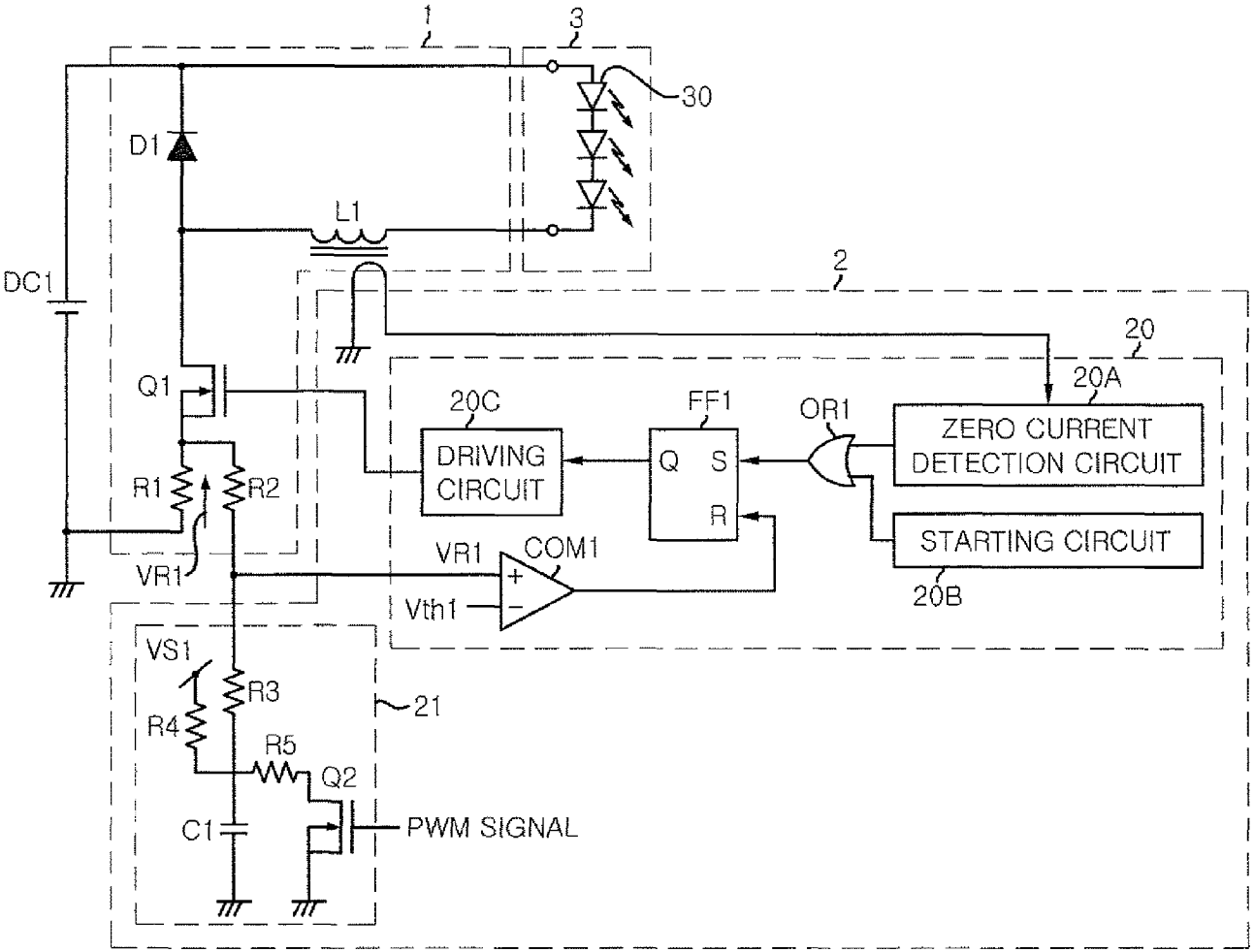

Hereinafter, a sixth embodiment of the lighting device in accordance with the present invention will be described with reference to the accompanying drawings. Here, a basic configuration of the present embodiment is common to that of the fifth embodiment, so the same reference numerals are used for the common parts and a description thereof will be omitted. As shown in FIG. 11A, this embodiment features that a resistor R5 is connected in series to the switching element Q2 in the threshold value adjusting unit 21.

Figure 11B:
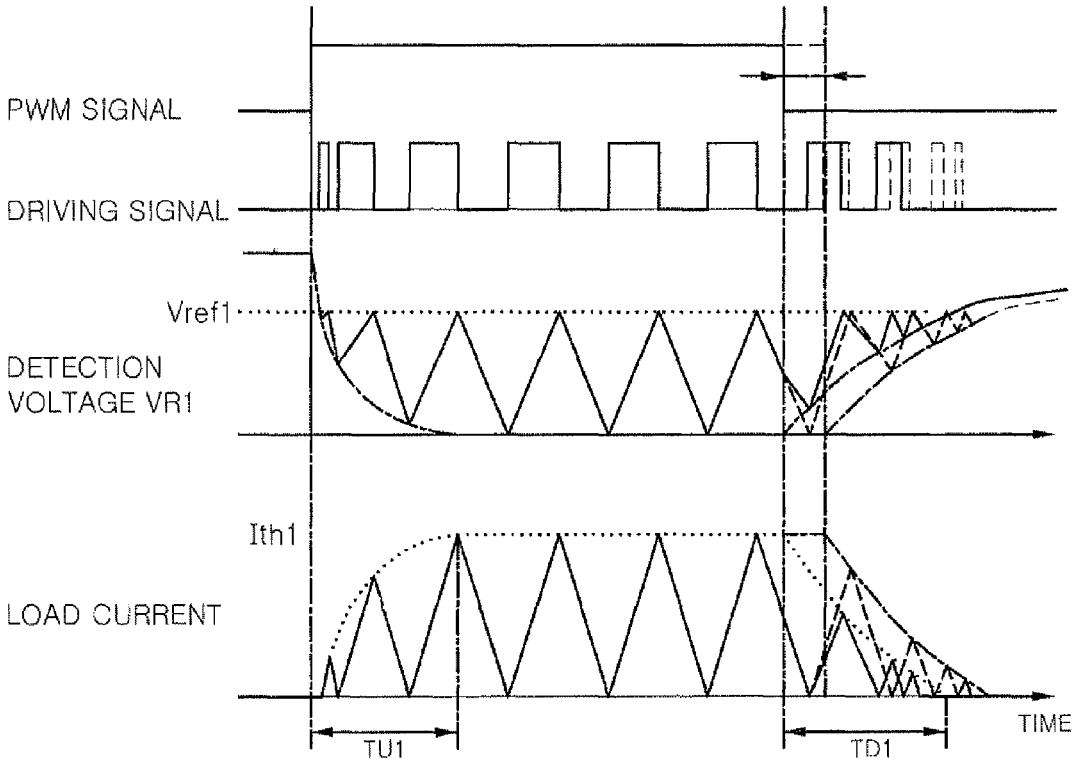

In the fifth embodiment, when the PWM signal is shifted from the OFF period to the ON period, the switching element Q2 is changed to be turned ON and shorted, the superimposed voltage V1 becomes zero almost in a moment. Meanwhile, in the present embodiment, since the resistor R5 and the capacitor C1 constitute an integrator circuit, the capacitor C1 is discharged and the charge voltage is exponentially reduced, and thus, the superimposed voltage V1 is also exponentially reduced when the PWM signal is shifted from the OFF period to the ON period, as shown in FIG. 11B. Thus, when, the PWM signal is shifted from the OFF period to the ON period, the peak value Ith1 of the load current is linearly increased. Namely, during the ON period of the PWM signal, likewise as in the third embodiment, the threshold value up period TU1 can be provided.

As described above, in the present embodiment, since the constant voltage supply VS1 and the resistors R4 and R5 are used without the constant current CS1, the same effect as that of the third and fourth embodiments can be obtained.

(Embodiment 7)

Figure 12A:
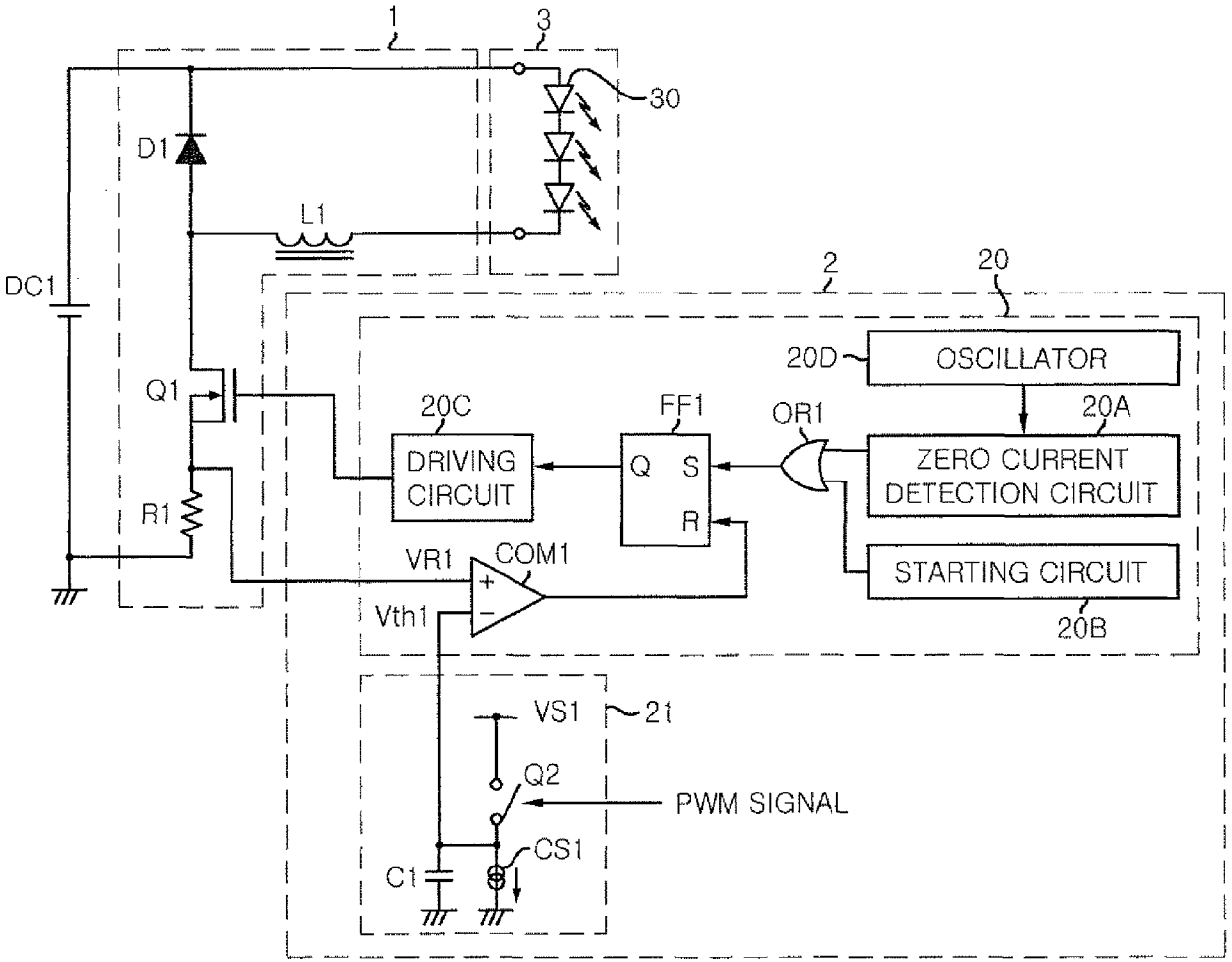

Hereinafter, a seventh embodiment of the lighting device in accordance with the present invention will be described with reference to the accompanying drawings. Since a basic configuration of the present embodiment is common to that of the first embodiment, the same reference numerals are used for the common parts and a description thereof will be omitted. As shown in FIG. 12A, the present embodiment features that an oscillator 20D for outputting an oscillation signal having a certain cycle, instead of the secondary coil of the inductor L1, is connected to the zero current detection circuit 20A of the driving controller 20.

Figure 12B:
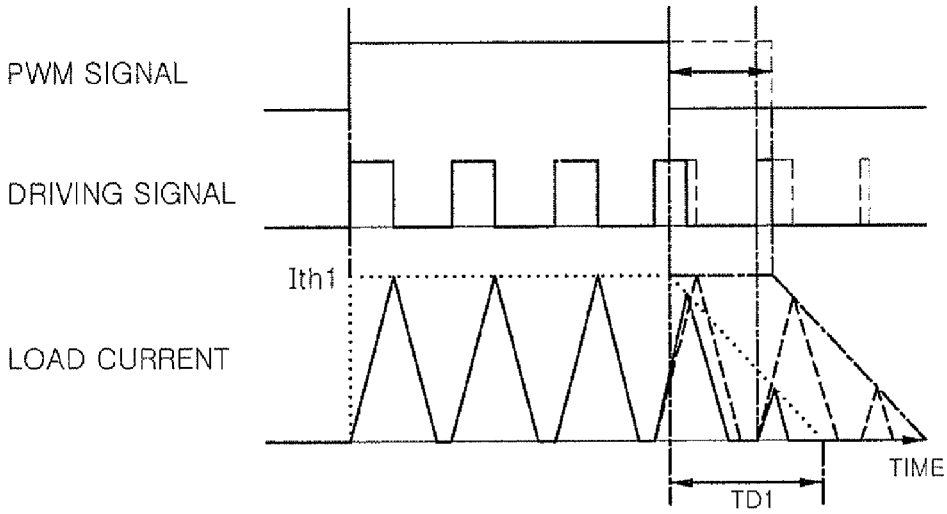

The zero current detection circuit 20A inputs a high signal to the OR circuit OR1 periodically based on the cycle of the oscillation signal applied from the oscillator 20D. Namely, in the present embodiment, only the ON time of the switching element Q1 is variably controlled, and the switching element Q1 is driven periodically, without detecting a zero cross of the load current. Accordingly, in the present embodiment, as shown in FIG. 12B, the switching element Q1 is controlled in a so-called current discontinuous mode in which the load current intermittently flows.

As described above, in the present embodiment, the switching element Q1 is controlled in the current discontinuous mode, but the same effect as that of the first embodiment can be obtained unlike the first embodiment. Further, in the present embodiment, the oscillation signal of the oscillator 20D is inputted to the zero current detection circuit 20A, but the zero current detection circuit 20A is not necessarily required and, e.g., a universal PWM control IC may be configured instead. Namely, a configuration, in which a high signal is inputted to the OR circuit OR1 periodically, is desirable.

(Embodiment 8)

Figure 13A:
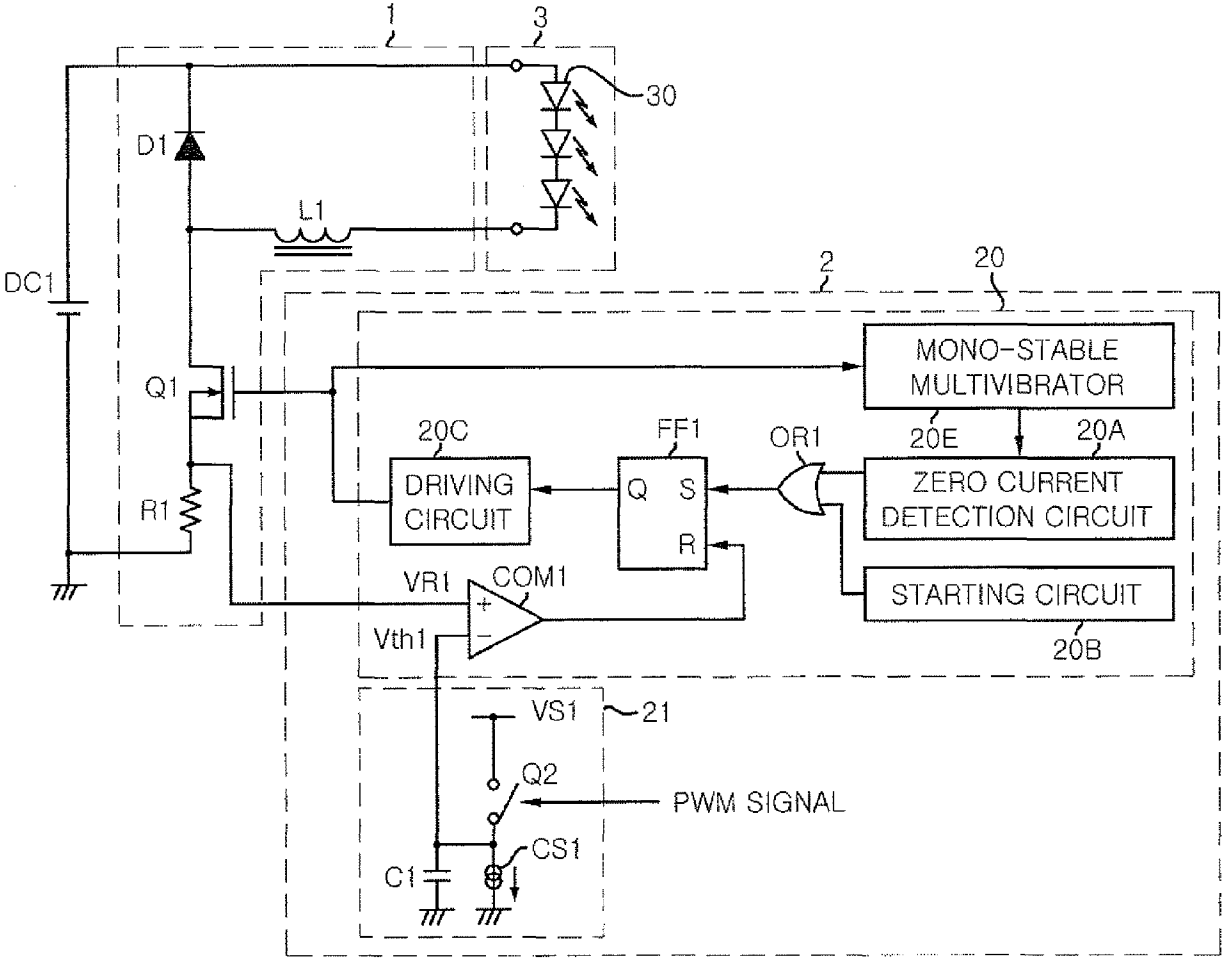

Hereinafter, an eighth embodiment of the lighting device in accordance with the present invention will be described with reference to the accompanying drawings. Since a basic configuration of the present embodiment is common to that of the first embodiment, the same reference numerals are used for the common parts and a description thereof will be omitted. As shown in FIG. 13A, the present embodiment features that a mono-stable multivibrator 20E, instead of the secondary coil of the inductor L1, is connected to the zero current detection circuit 20A of the driving controller 20.

Figure 13B:
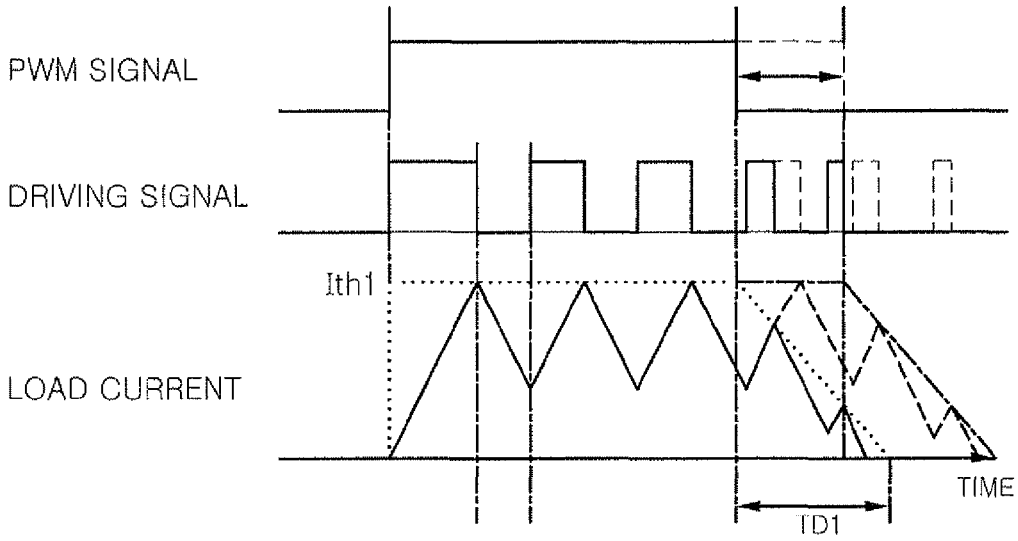

The mono-stable multivibrator 20E is connected to the driving circuit 20C, and after the driving signal from the driving circuit 20C is changed to be a low level, the signal is inputted to the zero current detection circuit 20A after the lapse of a certain period of time. When the signal is inputted from the mono-stable multivibrator 20E, the zero current detection circuit 20A inputs a high signal to the OR circuit OR1. Namely, in the present embodiment, the OFF time of the switching element Q1 is made constant and only the ON time of the switching element Q1 is variably controlled without detecting a zero-cross of the load current. Accordingly, in the present embodiment, as shown in FIG. 13B, the switching element Q1 is controlled in a so-called current continuous mode in which the load current continuously flows without being cut midway.

As described above, in the present embodiment, different from the first embodiment, the switching element Q1 is controlled in the current continuous mode but the same effect as that of the first embodiment can be obtained. Also, in the present invention, although a signal from the mono-stable multivibrator 20E is inputted to the zero current detection circuit 20A, the zero current detection circuit 20A is not necessarily required. Namely, a configuration, in which, after the switching element Q1 is changed to be turned off, a high signal is inputted to the OR circuit OR1 after the lapse of certain time, is desirable.

(Embodiment 9)

Figure 14A:
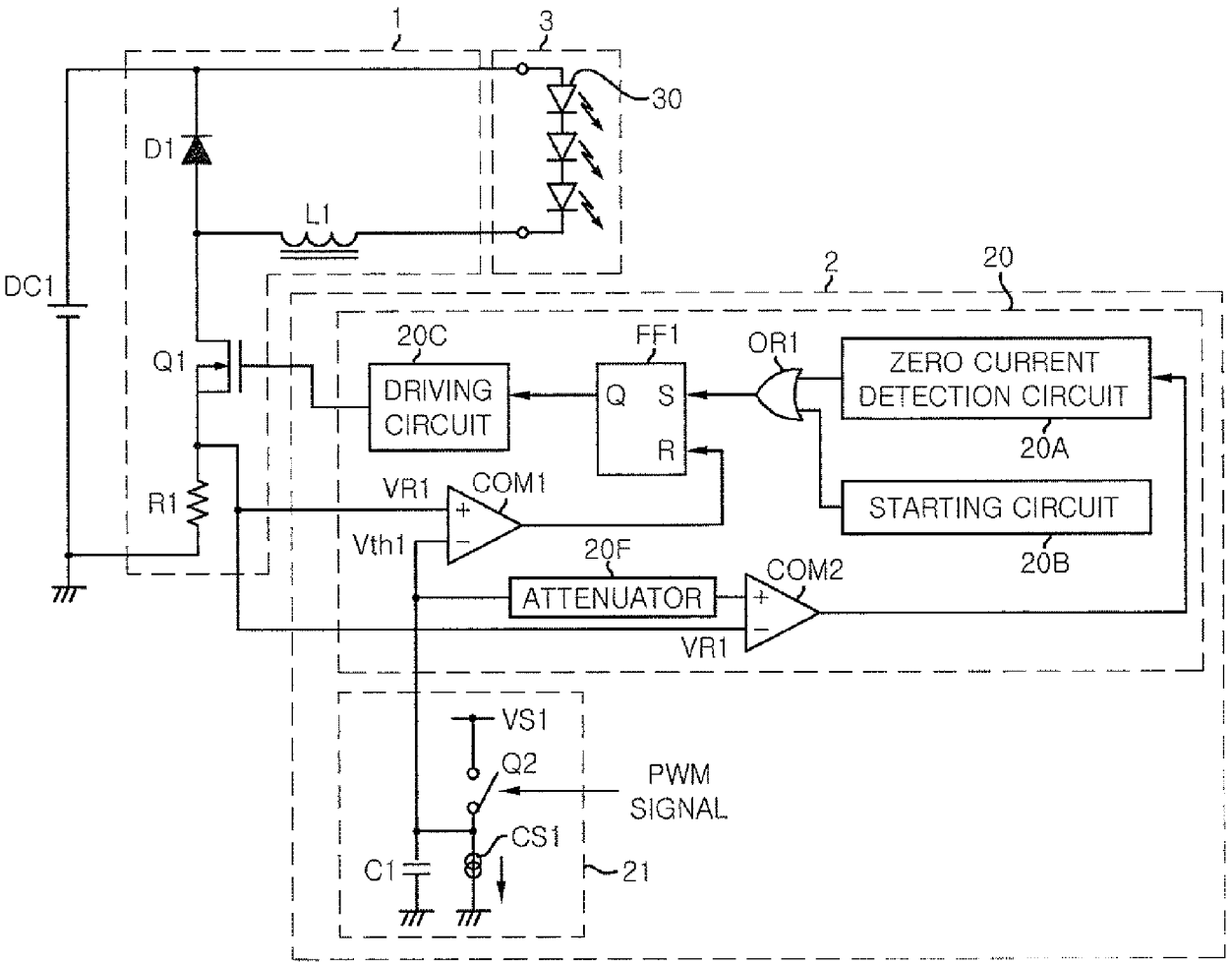
Figure 14B:
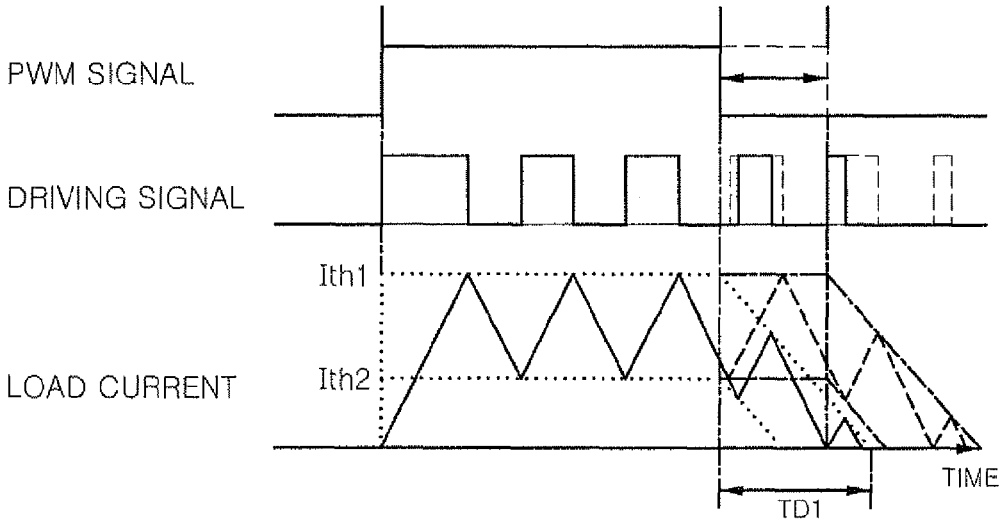

Hereinafter, a ninth embodiment of the lighting device in accordance with the present invention will be described with reference to the accompanying drawings. Since a basic configuration of the present embodiment is common to that of the first embodiment, the same reference numerals are used for the common parts and a description thereof will be omitted. As shown in FIGS. 14A and 14B, the present embodiment features that, in the zero current detection circuit 20A, the switching element Q1 is controlled based on the first peak value Ith1 and the second peak value Ith2 of the load current, instead of detecting a zero cross of the load current.

The driving controller 20 includes a comparator COM2 in which the detection voltage VR1 is inputted to an inverting input terminal and the reference voltage Vth1 is inputted to a non-inverting input terminal through an attenuator 20F. Further, the attenuator 20F attenuates the reference voltage Vth1 by K1 times (K1<1). An output terminal of the comparator COM2 is connected to the zero current detection circuit 20A.

In the present embodiment, the first peak value Ith1 and the second peak value Ith2 of the load current are set by the comparators COM1 and COM2, respectively. That is, with regard to the comparator COM1, as in the first embodiment, a constant voltage from the constant voltage supply VS1 or the charge voltage from the capacitor C1 in the threshold value adjusting unit 21 is inputted as the reference voltage Vth1 to the inverting input terminal. Accordingly, the driving controller 20 controls the switching element Q1 by using the first peak value Ith1 of the load current as the upper limit value.

Meanwhile, with regard to the comparator COM2, as mentioned above, the constant voltage from the constant voltage supply VS1 or the charge voltage from the capacitor C1 in the threshold value adjusting unit 21 is attenuated by the attenuator 20F and then inputted to the non-inverting input terminal. Thus, in the comparator COM2, when the detection voltage VR1 is lower than the input voltage of the non-inverting input terminal, a high signal is outputted to the zero current detection circuit 20A. When the high signal is inputted from the comparator COM2, the zero current detection circuit 20A inputs the high signal to the OR circuit OR1. Accordingly, the driving controller 20 controls the switching element Q1 by using the second peak value Ith2 of the load current as a lower limit value.

As described above, in the present embodiment, the switching element Q1 is controlled based on the first peak value Ith1 and the second peak value Ith2 of the load current, thus being controlled in the current continuous mode as in the eighth embodiment. Accordingly, in the present embodiment, the same effect as that of the first embodiment can also be obtained. In addition, in the present embodiment, the switching element Q1 can be controlled in the critical current mode by increasing the attenuation factor of the attenuator 20F to bring the second peak value Ith2 of the load current close to zero.

Further, in the present embodiment, a signal is inputted from the zero current detection circuit 20 to the OR circuit OR1, but the zero current detection circuit 20A is not necessarily required. Namely, it may be configured such that when an output signal from the comparator COM2 is changed to be high level, the high signal may be inputted to the OR circuit OR1.

(Embodiment 10)

Figure 15A:
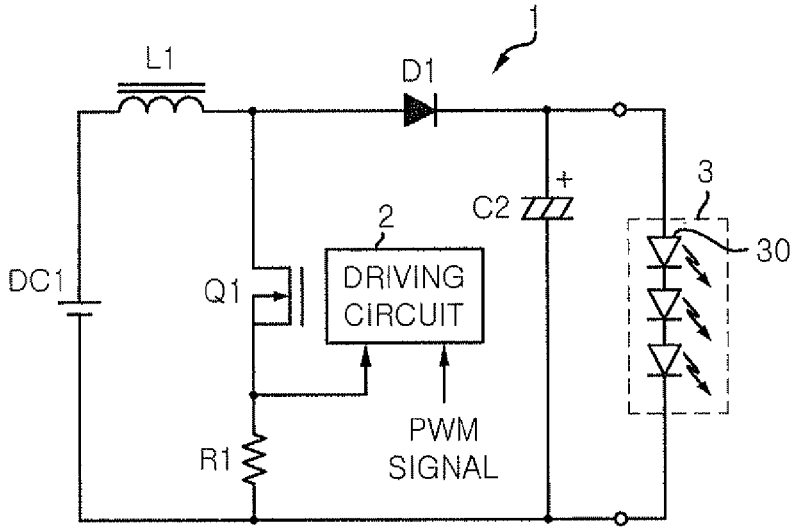

Hereinafter, a tenth embodiment of the lighting device in accordance with the present invention will be described with reference to the accompanying drawings. Since a basic configuration of the present embodiment is common to that of the first embodiment, the same reference numerals are used for the common parts and a description thereof will be omitted. As shown in FIG. 15A, the present embodiment features that the lighting unit 1 is configured as a boost chopper circuit. Also, in order to reduce ripple of the load current, the smoothing capacitor C2 is connected to the light source unit 3 in parallel.

Figure 15B:
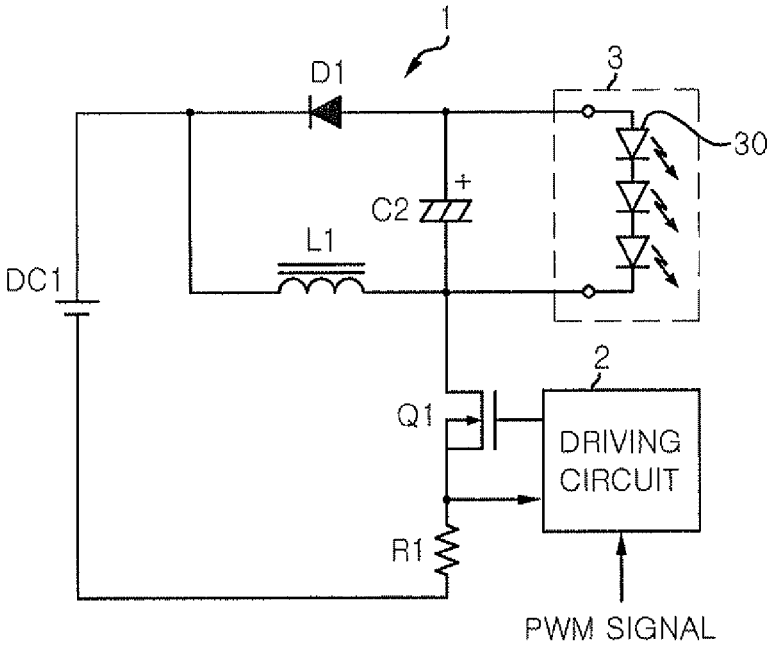
Figure 15C:
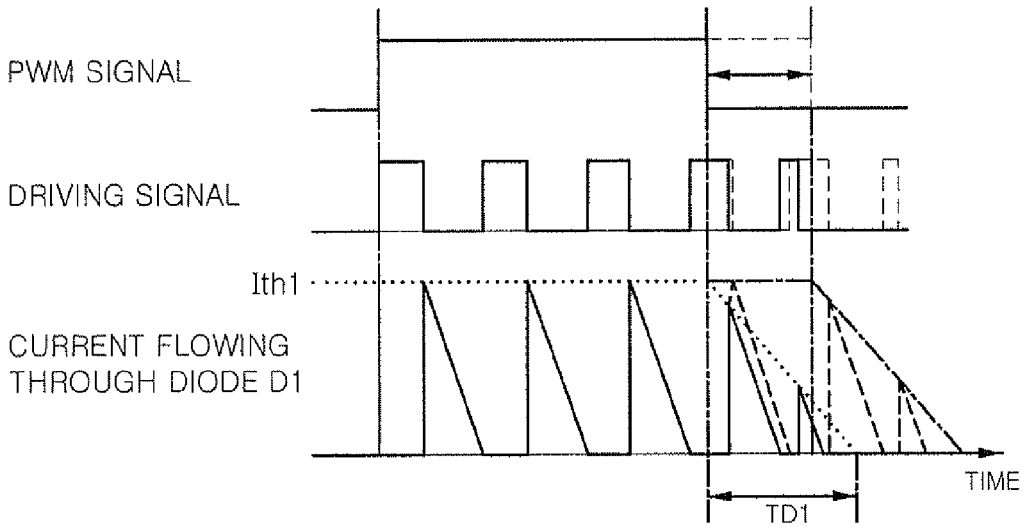

When the lighting unit 1 is configured as the boost chopper circuit, a current, which is equivalent to a load current, flows through the diode D1 during an OFF period of the switching element Q1, as shown in FIG. 15C. Further, in the present embodiment, since the threshold value down period TD1 is provided as in the first embodiment, the same effect as that of the first embodiment can be obtained.

Further, as shown in FIG. 15B, the lighting unit 1 may be configured as a buck-boost chopper circuit. In order to reduce ripple of the load current, the smoothing capacitor C2 is connected to the light source unit 3 in parallel. Also, in this case, as shown in FIG. 15C, a current flows through the diode D1 during the OFF period of the switching element Q1 to obtain the same effect as that of in the first embodiment.

Figure 16A:
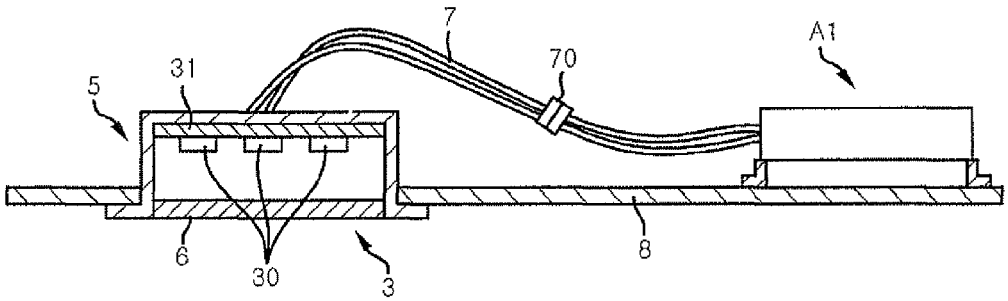

Hereinafter, an embodiment of an illumination apparatus in accordance with the present invention will be described with reference to the accompanying drawings. Also, the up and down direction in FIG. 16A is referred to as a vertical direction in the following description. Further, in the present embodiment, a lighting device in accordance with any of the foregoing embodiments may be used as a lighting device A1. As illustrated in FIG. 16A, this embodiment is a power source separation type illumination apparatus in which a power supply unit and the lighting device A1 are disposed to be separated from the light source unit 3, and a main body 5 for accommodating the light source unit 3 is disposed to be buried in a ceiling 8.

The main body 5 is made of a metallic material such as, e.g., an aluminum dicast or the like, and has a cylindrical shape with a bottom portion having an opening. The light source unit 3 including multiple (three in the drawing) of LEDs 30 and a substrate 31 mounting the respective LEDs 30 thereon is disposed bellow a ceiling portion within the main body 5. Further, the respective LEDs 30 are disposed such that a light irradiation direction faces downward to irradiate a light to an external space through the bottom portion of the main body 5. Further, a light-transmitting plate 6 is provided on the opening of the bottom portion of the main body 5 in order to diffuse light from the respective LEDs 30. The lighting device A1 is disposed at a different position from that of the main body 5 on a rear surface of the ceiling 8, and the lighting device A1 and the light source unit 3 are connected by a lead wire 7 through a connector 70.

Figure 16B:
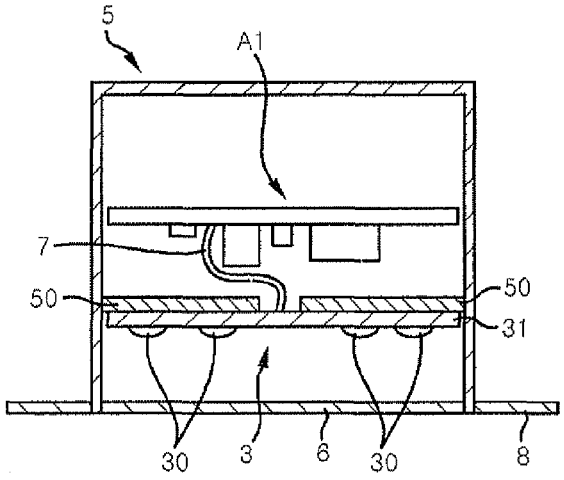
Figure 17:
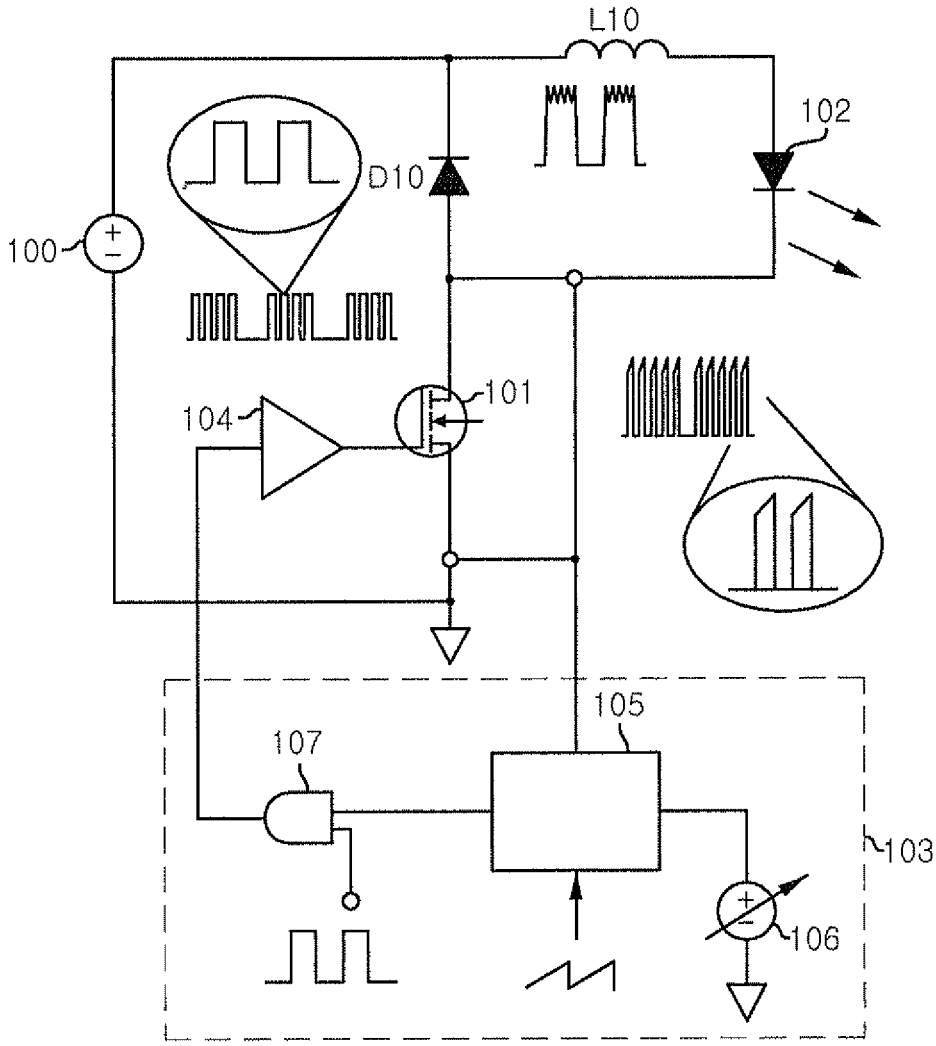
FIG. 17 (PRIOR ART)
FIG. 17 is a schematic circuit diagram of a conventional power feeding assembly for an LED illumination module.
Figure 18A:
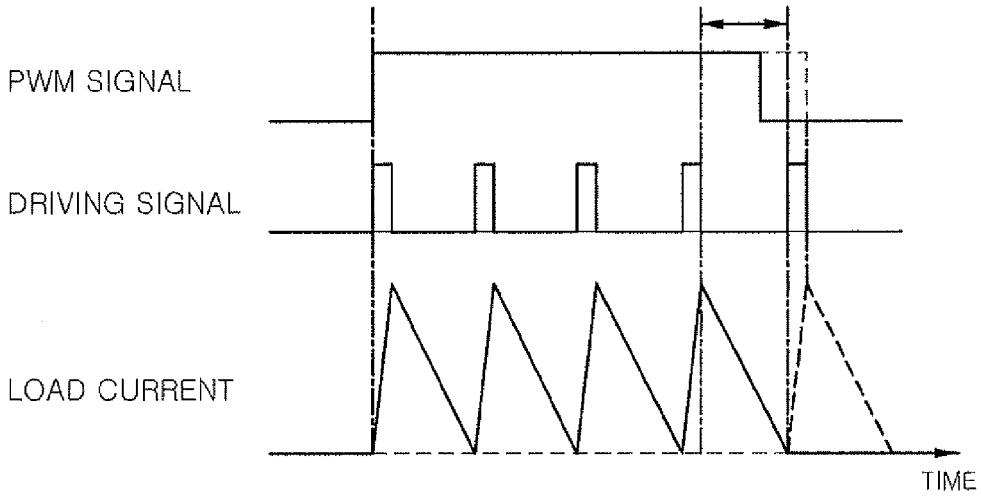
FIG. 18A (PRIOR ART)
Figure 18B:
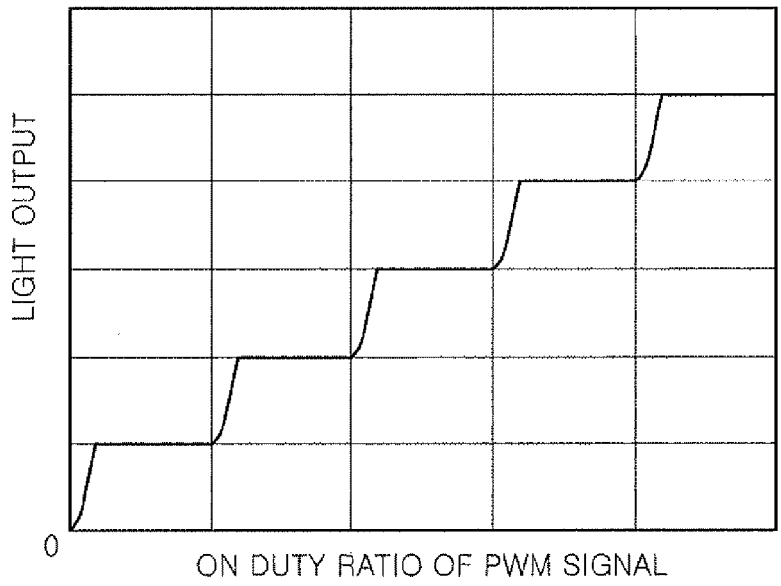
FIG. 18B (PRIOR ART)

The present embodiment as described above, which uses the lighting device A1 of any of the foregoing embodiments, can obtain the same effect as that of any of the foregoing embodiments. In addition, as shown in FIG. 16B, the present embodiment may be provided with an illumination apparatus of power supply integration type in which the lighting device A1 is installed along with the light source unit 3 in the main body 5. In this configuration, a heat dissipation plate 50 formed of an aluminum plate or a copper plate may be disposed to be in contact with the main body 5 on the rear surface of the substrate 31. Accordingly, a heat generated from the respective LEDs 30 can be released to the outside through the heat dissipation plate 50 and the main body 5.

Further, the foregoing first to tenth embodiments and the circuits of the respective drawings may be appropriately combined to be used. For example, the AC-DC converter in FIG. 4A may be applied to the lighting device of the first embodiment, and the boost chopper circuit or the buck-boost chopper circuit of the tenth embodiment may be applied to the lighting device of the first embodiment.

In accordance with the present invention, it is possible smoothly change a light output from a light source unit in sweeping a PWM signal without making a driving signal of a switching element have a high-frequency.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A lighting device comprising:

a lighting unit configured to supply a lighting power to a light source unit including one or more solid-state light emitting elements by using a DC voltage from a power supply unit as an input; and a controller configured to control the lighting unit, wherein the lighting unit includes a diode for recovering a stored energy of the inductor for the light source unit during an OFF period of the switching element and a series circuit of an inductor and a switching element, and the controller includes a first unit configured to intermittently drive an ON/OFF operation of the switching element by a PWM signal and a second unit configured to drive the switching element by a frequency higher than that of the PWM signal during an ON period of the PWM signal, and when the PWM signal falls, the controller is configured to reduce a peak value of a load current flowing through the light source unit during a certain period.

2. The lighting device of claim 1, wherein the lighting unit further includes a detection circuit configured to detect the load current flowing through the light source unit, and the controller further includes: a threshold value adjusting unit configured to set and outputting the peak value of the load current; a comparator configured to compare an output from the detection circuit with an output from the threshold value adjusting unit; and a driving controller configured to control an ON period of the switching element based on an output from the comparator.

3. The lighting device of claim 2, wherein the threshold value adjusting unit has a capacitor and a charging/discharging circuit configured to charge or discharge the capacitor based on the PWM signal, and outputs a charge/discharge voltage of the capacitor as the output.

4. The lighting device of claim 3, wherein the comparator compares a superimposed voltage obtained by superimposing the output from the detection circuit and that from the threshold value adjusting unit, with a certain reference voltage.

5. The lighting device of claim 1, wherein the certain period during which the peak value of the load current is reduced is longer than the OFF period of the switching element during the ON period of the PWM signal.

6. The lighting device of claim 1, wherein when the PWM signal rises, the controller controls the ON period the switching element to increase the peak value of the load current during a certain period.

7. The lighting device of claim 1, wherein the lighting unit is a buck chopper circuit.

8. The lighting device of claim 1, wherein the controller controls the switching element in a current critical mode.

9. The lighting device of claim 1, wherein the controller controls the switching element in a current discontinuous mode.

10. The lighting device of claim 1, wherein the controller controls the switching element in a current continuous mode.

11. The lighting device of claim 1, wherein the power supply unit includes an AC/DC converter unit configured to convert an AC voltage into a desired DC voltage and outputting the converted DC voltage, or a DC/DC converter unit configured to convert a DC voltage into a desired DC voltage and outputting the converted DC voltage.

12. The lighting device of claim 1, wherein the DC voltage from the power supply unit is obtained from an AC/DC converter and a frequency of the PWM signal is 600 Hz or a multiple of 600 Hz.

13. An illumination apparatus comprising the lighting device described in claim 1 and a main body for accommodating at least the light source unit.

* * * * *